US011078923B2

(12) United States Patent
Day

(10) Patent No.: US 11,078,923 B2
(45) Date of Patent: Aug. 3, 2021

(54) SOLID BODY VORTEX PUMP

(71) Applicant: New Fluid Technology Pty Ltd., Guanaba (AU)

(72) Inventor: Terence Robert Day, Mount Tamborine (AU)

(73) Assignee: New Fluid Technology Pty Ltd., Guanaba (AU)

( * ) Notice: Subject to any disclaimer, the term of this patent is extended or adjusted under 35 U.S.C. 154(b) by 174 days.

(21) Appl. No.: 16/535,612

(22) Filed: Aug. 8, 2019

(65) Prior Publication Data

US 2020/0072240 A1 Mar. 5, 2020

Related U.S. Application Data

(62) Division of application No. 14/412,456, filed as application No. PCT/AU2013/000752 on Jul. 9, 2013, now Pat. No. 10,400,791.

(30) Foreign Application Priority Data

| | | |
|---|---|---|
| Jul. 9, 2012 | (AU) | 2012902908 |
| Feb. 22, 2013 | (AU) | 2013900595 |
| Jun. 4, 2013 | (AU) | 2013902013 |

(51) Int. Cl.
*F04D 29/44* (2006.01)
*F04D 1/00* (2006.01)

(52) U.S. Cl.
CPC ..... *F04D 29/445* (2013.01); *F04D 1/00* (2013.01)

(58) Field of Classification Search
CPC ..... F04D 29/4286; F04D 29/007; F04D 1/00; F04D 5/001; F04D 5/00
See application file for complete search history.

(56) References Cited

U.S. PATENT DOCUMENTS

| | | | |
|---|---|---|---|
| 1,291,037 | A | 1/1919 | Lole |
| 2,635,548 | A | 4/1953 | Brawley |

(Continued)

FOREIGN PATENT DOCUMENTS

| | | |
|---|---|---|
| EP | 0597815 | 1/1997 |
| JP | 2001-355590 | 12/2001 |

(Continued)

OTHER PUBLICATIONS

International Search Report for corresponding PCT Application No. PCT/AU2013/000752 dated Oct. 4, 2013.

(Continued)

*Primary Examiner* — Richard A Edgar
(74) *Attorney, Agent, or Firm* — Caesar Rivise, PC

(57) ABSTRACT

A pump includes a pump casing that defines a pump chamber, the pump casing having an inlet and an outlet. An impeller is arranged with respect to the pump chamber to displace fluid from the inlet into the pump chamber. A vortex shaping mechanism is arranged in the pump chamber and is configured to constrain fluid within the pump chamber into a rotational flow pattern about a rotational axis. At least the casing and the vortex shaping mechanism are configured so that a portion of the fluid is encouraged to establish a solid body vortex, with an outer periphery of the solid body vortex being determined by the vortex shaping mechanism, and a portion of the fluid defining a diffusion zone in fluid communication with the outlet such that fluid cant diffuse across a fluid interface between the solid body vortex and the diffusion zone to generate a pumping pressure at the outlet.

12 Claims, 26 Drawing Sheets

(56) References Cited

U.S. PATENT DOCUMENTS

| | | | | |
|---|---|---|---|---|
| 3,437,047 | A | 4/1969 | Walsh et al. | |
| 4,373,860 | A | 2/1983 | Sloan | |
| 4,575,308 | A | 3/1986 | Corkill | |
| 5,509,779 | A * | 4/1996 | Mori | F04D 9/02 415/56.1 |
| 8,967,971 | B2 | 3/2015 | Day | |
| 2013/0101424 | A1 | 4/2013 | Bright et al. | |

FOREIGN PATENT DOCUMENTS

| | | |
|---|---|---|
| WO | WO 85/02658 | 6/1985 |
| WO | WO 2010/147932 | 12/2010 |

OTHER PUBLICATIONS

Examination Report for corresponding India Patent Application No. 984/DELNP/2015 dated Jun. 24, 2019.

* cited by examiner

SOLID BODY VORTEX PUMP

CROSS REFERENCE TO RELATED APPLICATIONS

This Divisional application claims the benefit under 35 U.S.C. § 121 of application Ser. No. 14/412,456 filed on Jan. 2, 2015 which in turn is a U.S. national phase application that claims the benefit under 35 U.S.C. § 371 of International Application Serial No. PCT/AU2013/000752 filed on Jul. 9, 2013 which in turn claims the benefit of Australian patent applications 2012902908 filed on Jul. 9, 2012 and 2013900595 filed on Feb. 22, 2013 and 2013902013 filed on Jun. 4, 2013 and all of whose entire disclosures are incorporated by reference herein.

FIELD

The following specification describes various exemplary embodiments of a pump.

BACKGROUND

Australian patent application 2010241317 ("New Fluid '317"), published on 25 Nov. 2010, describes various embodiments of a pump that makes use of the principles of solid body vorticity. Where applicable, the contents of New Fluid '317 are to be considered incorporated in this specification.

DESCRIPTION OF EXEMPLARY EMBODIMENTS

Figure 1:
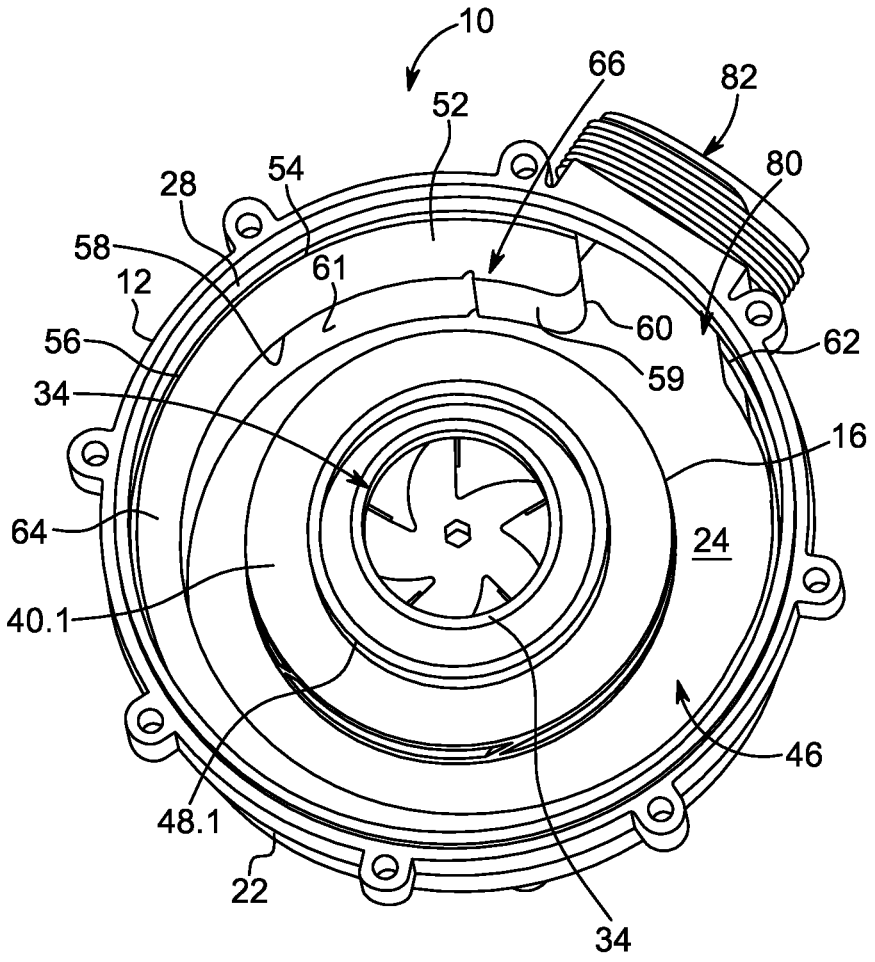
FIG. 1 shows an internal, three-dimensional view of an exemplary embodiment of a pump.
Figure 2:
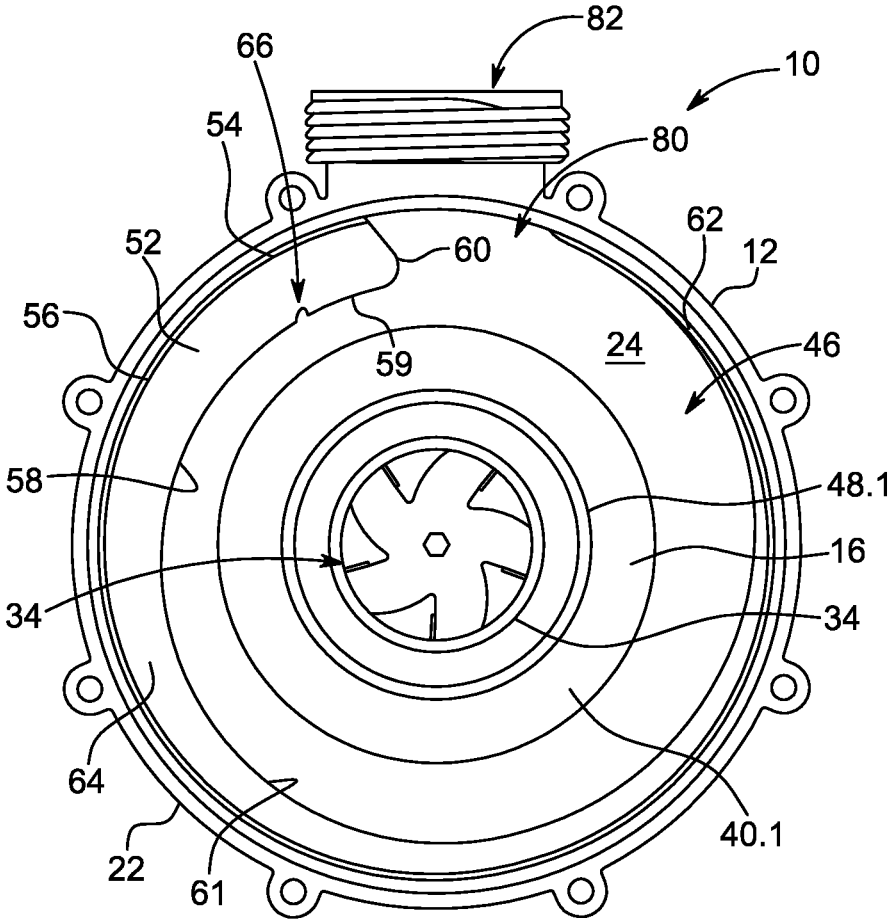
FIG. 2 shows an internal, two dimensional view of the pump of FIG. 1.
Figure 3:
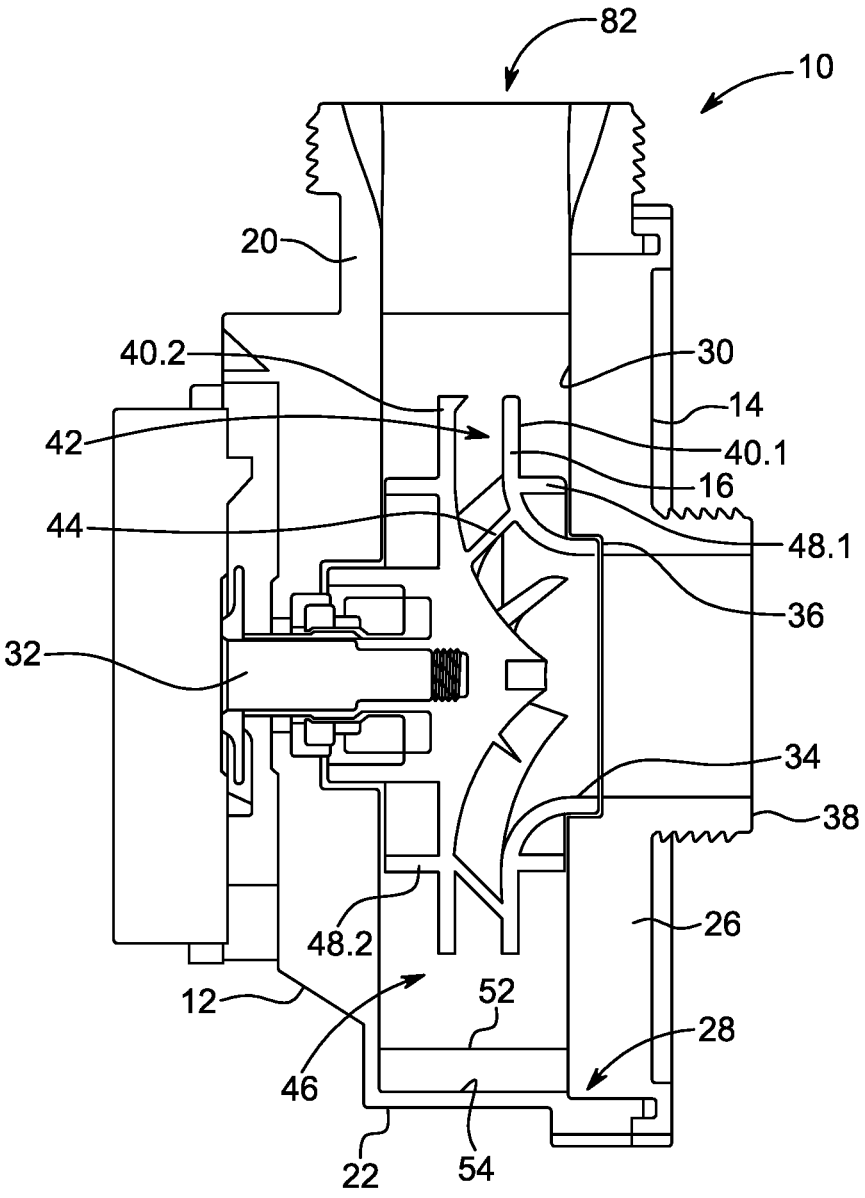
FIG. 3 shows a schematic side sectional view of the pump of FIG. 1.
Figure 4:
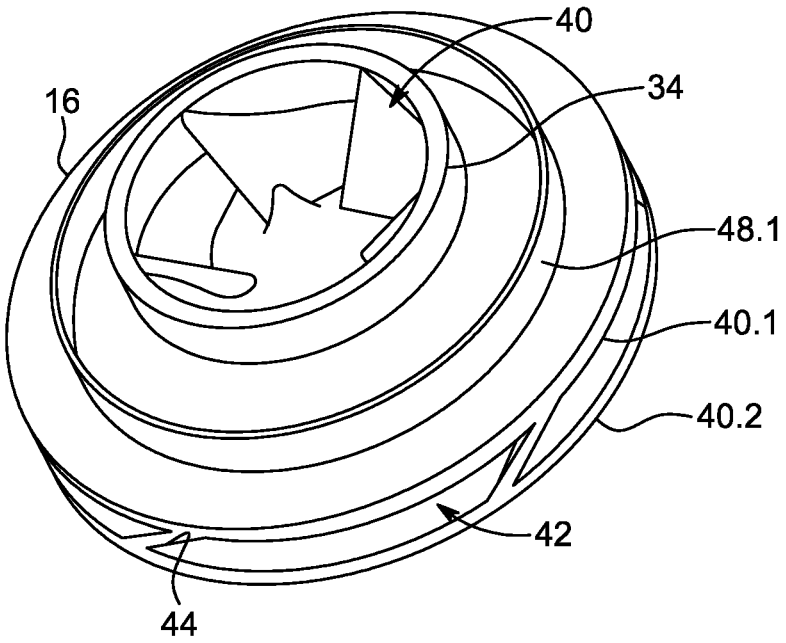
FIG. 4 shows a three-dimensional view from an inlet side of an exemplary embodiment of an impeller that is suitable for the pump of FIG. 1.

In FIGS. 1, 2 and 3, reference numeral 10 generally indicates an exemplary embodiment of a pump.

The pump 10 includes a pump housing 12. In FIGS. 1 and 2, a cover 14 (shown in FIG. 3) is removed to show an impeller 16 and an insert 52 that includes a vortex shaping mechanism within the housing 12.

The housing 12 is generally cylindrical with a rear wall 20 (FIG. 3) and a cylindrical sidewall 22 extending from a periphery of the rear wall 20. The rear wall 20 defines a generally flat internal surface 24. The internal surface 24 and the sidewall 22 define a corner with an internal radius of less than about 10 mm. The cover 14 defines a front wall 26. The sidewall 22 defines a peripheral shoulder 28 so that the cover 14 can nest in the sidewall 22, on the shoulder 28. The front wall 26 defines a generally flat internal surface 30 (FIG. 3). The internal surface 30 and the sidewall 22 define a corner with an internal radius of less than about 10 mm.

The impeller 16 is mounted on a drive shaft 32 that extends through the rear wall 20 and can drive the impeller 16 in a conventional manner.

In this embodiment, the impeller 16 is dimensioned at least partially to span the housing 12 axially. Furthermore, an inlet formation 34 of the impeller 18 is received in a cylindrical shoulder 36 defined by the front wall 26. The front wall 26 includes an inlet 38 that terminates at the shoulder 36 so that the inlet 38 is in fluid communication with the inlet formation 34 of the impeller 16.

The impeller 16 includes an impeller front wall 40.1 and an impeller rear wall 40.2. The walls 40 are radially coterminous.

Figure 5:
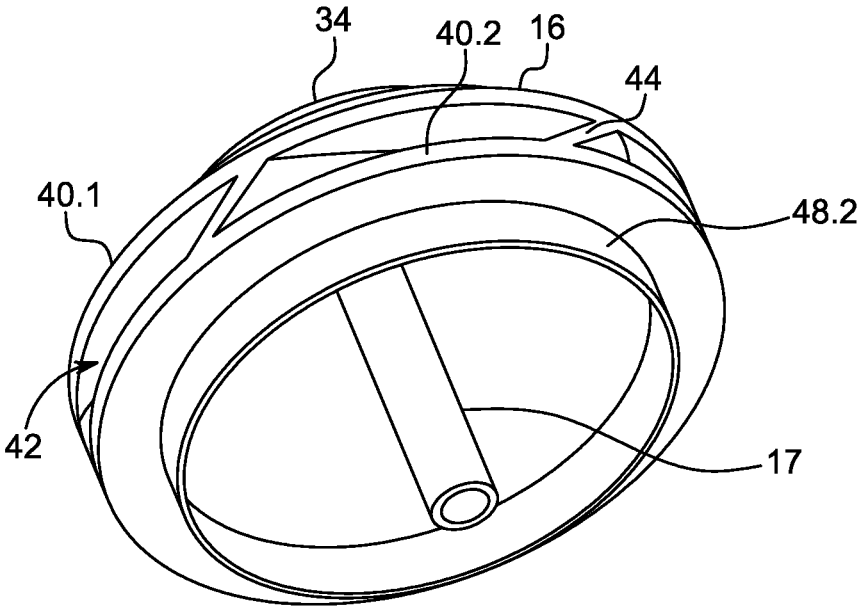
FIG. 5 shows a three-dimensional view from a drive side of the impeller of FIG. 4.
Figure 6:
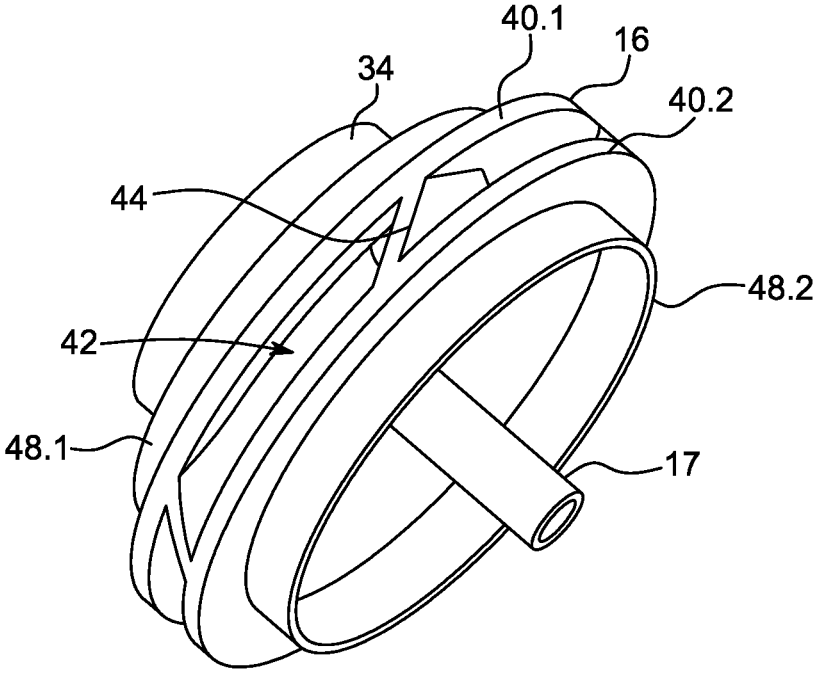
FIG. 6 shows a further three-dimensional view of the impeller of FIG. 4.

The impeller 16 includes a shaft mount 17 (FIGS. 5 and 6) that extends from the rear wall 40.2 so that the impeller 16 can be mounted on the drive shaft 32.

The walls 40 define a zone 42 in fluid communication with the inlet 38. Vanes 44 are arranged between the walls 40 and in the zone 42 so that rotation of the impeller 16 can draw fluid into the zone 42 and direct that fluid into a chamber 46 between the cylindrical sidewall 22 and the impeller 16. The vanes 44 are also radially coterminous with the walls 40. It follows that a radial profile of the impeller 16 defines a flat edge that is generally parallel to an axis of rotation of the impeller.

Front and rear cylindrical walls 48.1 and 48.2 extend from the front and rear walls 40.1,40.2, respectively, of the impeller 16. The walls 48 terminate in close proximity to the rear and front surfaces 24, 30. The walls 40, 48 are generally orthogonal with respect to each other. Thus, the chamber 46 has a radial profile including substantially 90° angles. This provides the chamber 46 with an annular shape with generally flat front and rear sides and an outer or peripheral cylindrical side.

Figure 7:
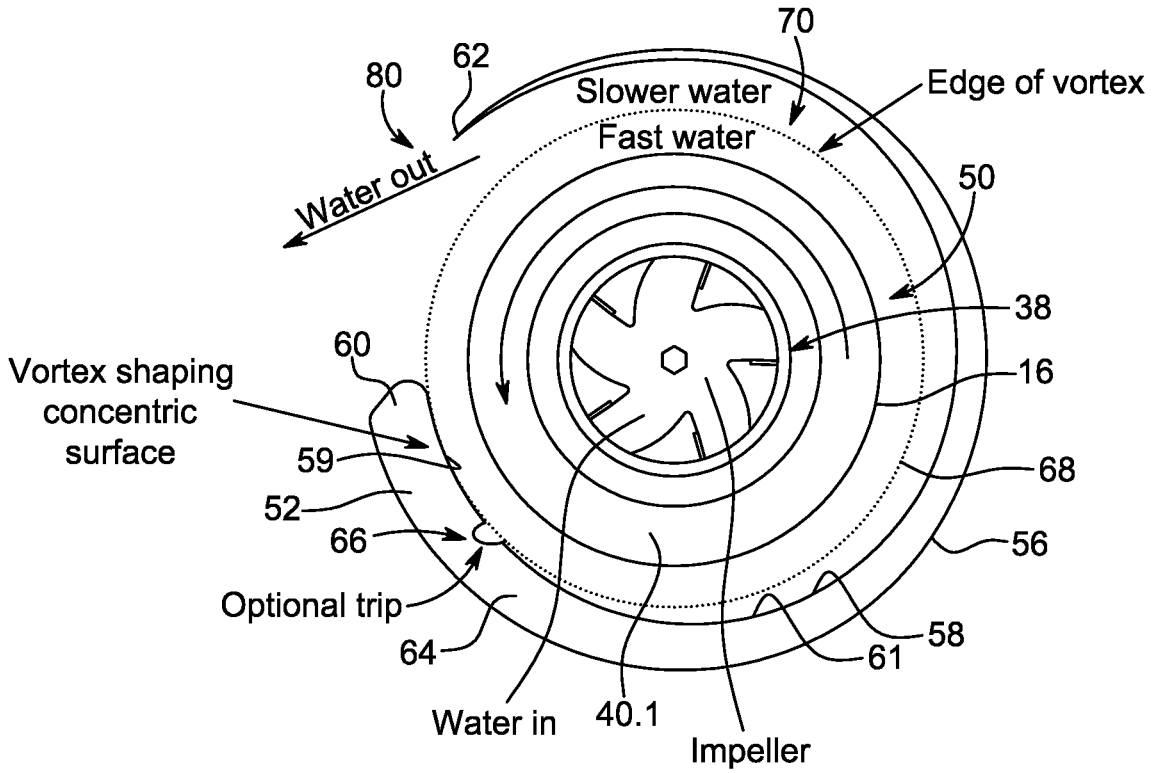
FIG. 7 shows a diagram illustrating a principle of operation of the pump of FIG. 1.

The pump 10 is configured to generate a solid body vortex in the housing 12. The generation of the solid body vortex is illustrated in FIG. 7. The rotation of the impeller 16 sets up a rotational flow of a body of fluid, in this embodiment, liquid, such as water, in a zone 50 about the impeller 16. The profile of the chamber 46, as described above, encourages the establishment of a solid body vortex in the zone 50. In particular, the fact that the angles defined by the radial profile of the zone 50 do not exceed substantially 90° inhibits the generation of axial currents which would tend to break down the solid body vortex.

The insert 52 is positioned on an internal surface 54 of the cylindrical sidewall 22. The insert 52 has an outer side 56 shaped to correspond with the internal surface 54. An inner side 58 is spaced from the outer side 56 at a leading surface 60 and intersects the outer side 56 at a trailing end 62. The leading surface 60 has a radial profile that is curved to provide liquid flow transition while inhibiting cavitation. The outer side 56, inner side 58 and leading surface 60 are interposed between generally flat sides 64.

In use, the insert 52 is positioned so that the leading surface 60 diverts a rotational flow of liquid generated by the impeller 16, in this embodiment, in an anticlockwise direction, when viewed from the front, so that a rotational liquid flow is set up in the zone 50. Thus, the insert 52 serves to define a diameter or outer periphery of the zone 50. More particularly, a leading portion 59 of the inner side 58 has a consistent radius that is set at a desired outer or maximum radius for the zone 50. An arc length of the leading portion is selected so that the leading portion 59 can constrain fluid sufficiently to set up a circular or rotational flow pattern. One example of a suitable arc length is 20 mm to 30 mm. However, this will depend on the overall size of the pump, for example the pump chamber diameter. Thus, the leading portion 59 defines the vortex shaping mechanism referred to above.

It will be appreciated that there may be a tendency for the liquid to be deflected towards a trailing portion 61 of the inner side 58, downstream of the leading portion 59, and thus outside the zone 50 with the insert acting as a hydrofoil. Thus, the insert 52 defines an axial recess or "trip" 66 that opens into the inner side 58 at or near the leading surface 60. The recess 66 demarcates the leading portion 59 and trailing portion 61. The recess 66 serves to break up or disturb laminar flow along the portion 59 and so to detach or divert the liquid in the zone 50 from the insert 52 so that the liquid can remain in the zone 50.

It will be appreciated that dimensions of the insert 52 can be selected to suit dimensions of the housing 12. For example, the insert 52 can be selected so that a pump chamber with an internal diameter of about 120 mm to 180 mm, for example, 170 mm can be provided with an insert that is dimensioned so that a diameter of the zone 50 is between about 90 mm and 150 mm, for example 145 mm. This means that the insert 52 has a radial thickness of between about 20 mm and 30 mm, for example 25 mm along an arc of the leading portion 59 in this example. This provides some guidance to a nominal skilled person for fabricating the insert 52. For example, a ratio of 1:5 to 1:10, such as 1:7 could be suitable for an insert radial thickness to chamber diameter relationship. Axial thickness or width of the insert could be selected based on other factors. One factor would be impeller dimensions. For example, the arc length of 20 mm to 30 mm could be suitable for an impeller with a diameter of between about 100 mm and 120 mm. Thus, with a thickness of between about 20 mm and 30 mm along the arc of the leading portion, a solid body vortex with a radial thickness of up to 80 mm can be achieved. The arc length of 20 mm to 30 mm for the leading portion 59 can also be used to provide an indication of a location of the recess 66 for differently sized inserts by scaling up or down.

It will be appreciated that inserts with different dimensions can replace the insert 52. Replacement can depend on the characteristics of the pump with which the insert is to be used.

The inventor envisages that a person of ordinary skill in the art would consider that it would be appropriate to try different dimensions and ratios to achieve different pump characteristics.

In some cases, the insert and the impeller can be used to retrofit a conventional pump. An existing impeller can be replaced with the impeller of the embodiments. The insert can be located in a pump housing of the existing pump in general axial alignment with the impeller. The pump housing needs to have a suitable internal configuration. However, it is envisaged that an internal casing can be provided to fit within an existing casing of a pump. The internal casing can then provide the necessary suitable internal configuration.

As shown in FIG. 7, a naturally occurring interface 68 results between fluid in the zone 50 and fluid in a diffusing zone 70 outside the zone 50. A radius of the interface 68 is determined by a radius of the portion 59. The generation of the interface 68 results from the principles of solid body vorticity. As is known, substantially no shear exists between fluid molecules in a solid body vortex. The fluid molecules tend to "line up", spoke fashion, both radially and axially within the solid body vortex of the zone 50. As a result, angular velocity of the fluid in the zone 50 is constant throughout the zone 50, in other words, an RPM value of the fluid remains constant throughout the zone 50.

Thus, a radially outer surface of the solid body vortex in the zone 50 has a speed that is significantly higher than a speed of water in the zone 70. The differential speed together with the characteristics of the liquid or water in the zone 50 serves to establish and maintain the interface 68. Surprisingly. and counter intuitively, the relatively higher speed of the water in the zone 50 at the interface 68 does not result in centripetal forces driving the water into the diffusing zone 70. Such movement of the water would result in the breakdown of the solid body vortex.

Figure 8:
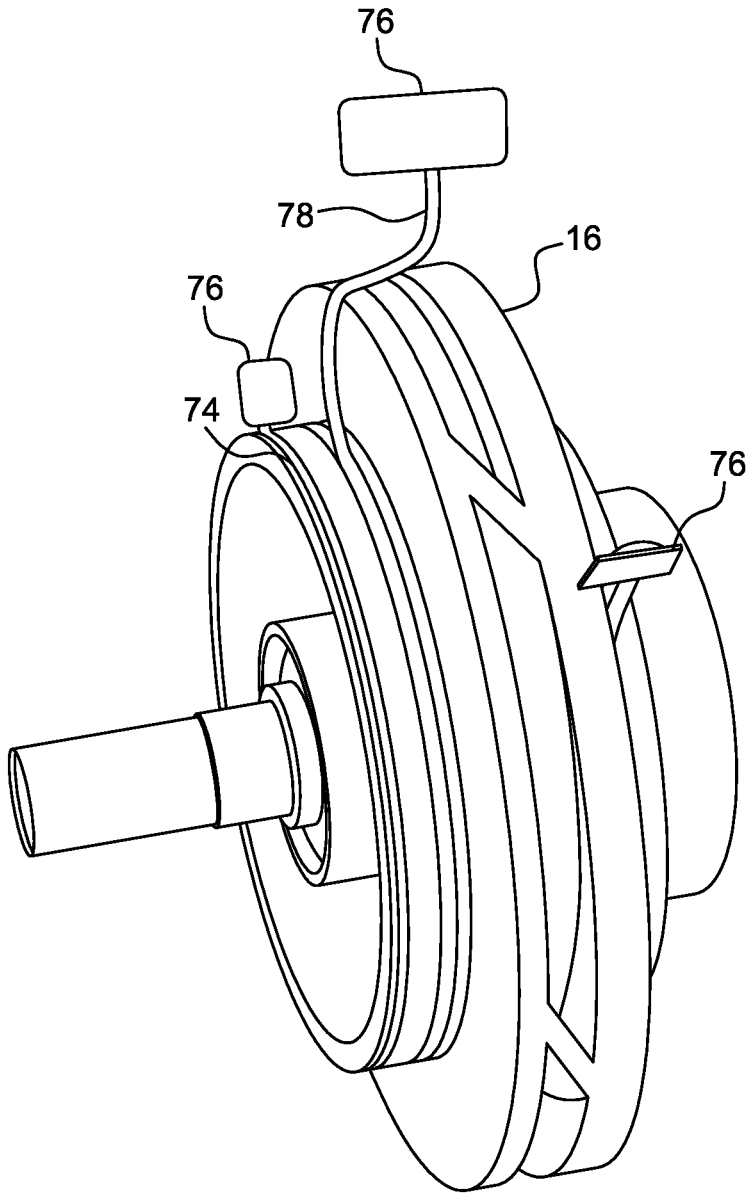
FIG. 8 shows one view of an impeller including a testing apparatus used to test the principle of operation of the pump of FIG. 1.
Figure 9:
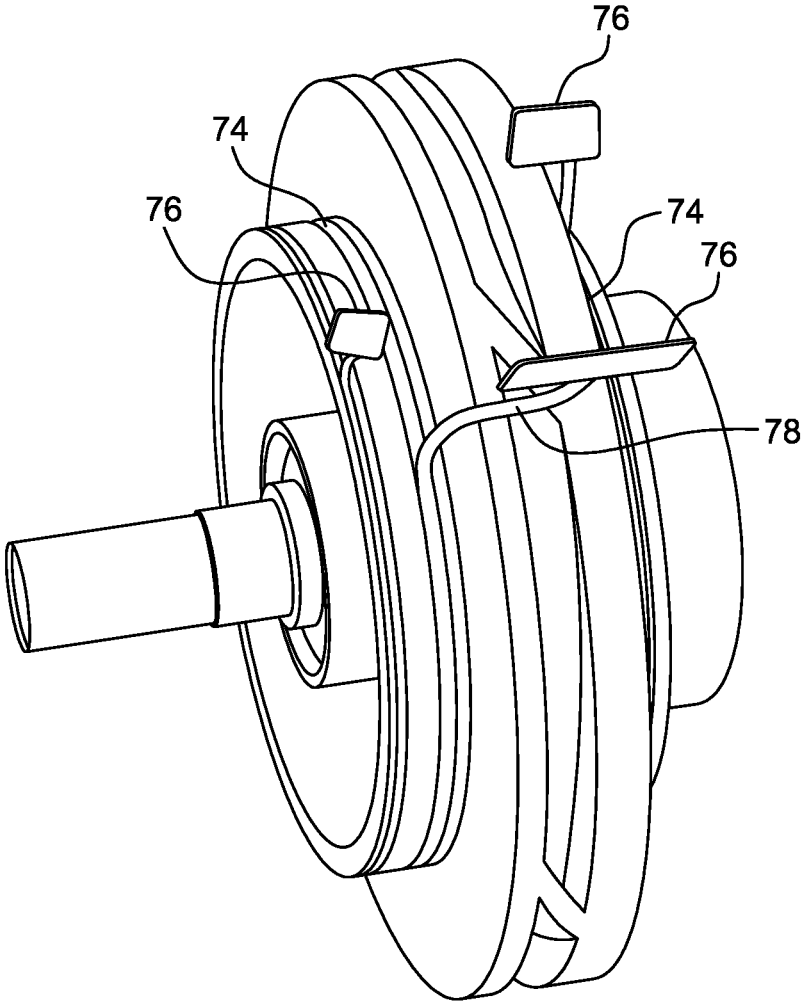
FIG. 9 shows another view of the impeller and testing apparatus of FIG. 8.

The inventor has carried out a number of experiments related to the generation of a solid body vortex in the zone 50. In one experiment, the cylindrical walls 48 of the impeller 18 are provided with grooves (FIGS. 8 and 9). A ring 74 is positioned in each groove to rotate freely with respect to the impeller 16. Paddles 76 are mounted at different radial distances from the impeller 16 within the zone 50 by means of suitable arms 78 that interconnect the rings 74 and the paddles 76.

It is found that relative positions of the paddles 76 remain constant while the pump 10 is operational. This demonstrates that a solid body vortex exists within the zone 50. More particularly, it demonstrates that the water molecules remain aligned, as described above. The paddles 76 would move relative to each other were that not the case.

It will be appreciated that for pumping to occur, it is necessary that water passes through the interface 68. Given the existence of the solid body vortex, this movement of water can only be by way of diffusion across the interface 68.

Thus, the water does not actually flow out of the vortex as a result of centripetal forces but is rather ejected from the zone 50 by diffusion. The ejected water immediately slows in the diffusing zone 70 with the result that the zone 70 acts as a diffuser. Diffusers serve to slow a fluid so that a static pressure is raised in order to generate a pumping heed. In this case, it follows that the water in the zone 70 has a higher static pressure than the water in the zone 50. The static pressure increases as the water progresses about the internal surface 54 from the recess 66 to a position indicated at 80 (FIGS. 1 and 2).

Thus, an outlet 82 is arranged on the cylindrical sidewall 22 to be in fluid communication with the zone 70 at 80.

In conventional pumps, for example centrifugal pumps, the diffusers have walls that entirely define a diffusing zone. These walls can be any shape provided they extend about the diffusing zone, in radial cross section. Such diffusers are referred to as volutes.

However, in this embodiment, and in various exemplary embodiments, the diffusing zone 70 is partially defined by the interface 68 which can be regarded as a dynamic wall of separation. This is analogous to an air curtain that blows down into a doorway of a building. This can keep air-conditioned air inside a building even though there is no actual solid wall separating the areas. Another analogy is that of a vortex ring. These are often referred to as "smoker's rings", with the smoke making them visible. A low-pressure zone at a periphery of the vortex ring interfaces with a relatively higher ambient pressure. This serves to maintain the vortex ring, temporarily. The vortex ring decays since the required energy to maintain the ring is only delivered once.

The existence of a non-solid interface provides a transfer of fluid from the zone 50 to the diffusing zone 70 without significant drag. This is m contrast to a conventional pump where a solid diffuser would necessarily result in drag and loss of efficiency. Based on the speed of diffusion (about 1497 m/s in water and 343 m/s in air) that transfer of fluid is also at a speed which is higher than the transfer of fluid from an impeller to a diffuser in a conventional pump.

In this and various exemplary embodiments, energy is continuously supplied or provided by the impeller so that the generation of the solid body vortex and the subsequent diffusing zone 70 within the housing 12 is a dynamic, continuous process.

In various experiments, the inventor has found that a speed of the solid body vortex periphery can be 8 to 10 times higher than a speed of water in the diffusing zone 70. As a result, a relatively low static pressure in the zone 50 exists compared to a relatively higher static pressure in the zone 70. Usually, fluid would flow from an area of relatively high static pressure to an area of relatively low static pressure. However, in this and various embodiments, the impeller continuously injects fluid into the zone 50 resulting in fluid diffusing out of the zone 50 and into the zone 70.

A relatively low pressure of fluid in the zone 50 results in fluid being driven into the zone 50 from the impeller 16 under atmospheric pressure once the vortex is established. This is in contrast to conventional pumps in which the impeller acts to direct or drive fluid away from the impeller into a static or structural diffuser. Counter-intuitively, therefore, the impeller 16 is required primarily to set up the vortex rather than to maintain flow through the pump. A resultant pressure differential across fluid in the inlet and the vortex causes fluid to be directed into the zone 50 from the impeller 16. Intuitively, it could be assumed that fluid is "flung" or "driven" into the zone 50 by the impeller. However, it is the existence of the vortex and a resultant relative low pressure in the zone 50 that serves to ensure flow of fluid into the zone 50. The fluid that enters the zone 50 from the impeller 16 is constrained within the vortex. Diffusion is the mechanism by which the fluid leaves the zone 50 and enters the zone 70 to maintain equilibrium in the zone 50. Thus, the vanes 44 of the impeller 16 can be configured for initiating fluid flow and subsequently accommodating fluid flow through the impeller. As a result, there are less design constraints on various exemplary embodiments of the impeller when compared to conventional impellers. For example, as set out below, it is possible to use an impeller in which a direct path or passage from vanes of the impeller to a diffusion zone is obstructed to cause a rise in fluid pressure within the impeller.

As indicated in the experiment described above, as water is injected into the zone 50 from the impeller 16, any resulting disturbances are substantially instantly smoothed and adjusted by diffusion of the molecules in all directions. This also counteracts the tendency of turbulence that could result from the continuous injection of water from the impeller into the zone 50. The paddles 76 would rotate relative to each other if the disturbances were maintained.

The principles of solid body vortices teach that the solid body state can be maintained indefinitely provided sufficient energy is imparted to the fluid. The fluid should also be retained in a structure configured to encourage the generation and maintenance of a solid body vortex. In this embodiment, the energy is imparted by the impeller. The insert 52, the shape of the impeller 16 and the surfaces 24, 30, 54 provide the necessary structural configuration.

As described above, the existence of the vortex generates a region of relative low pressure in the zone 50. In some cases, the generation of a low pressure zone can lead to cavitation, which is undesirable. Cavitation can lower pump efficiency and could also result in the vortex self-destructing. The walls 48 serve to occupy a zone where such cavitation could occur. Thus, the walls 48 define an anti-cavitation means. As the impeller 16 rotates, so do the walls 48. The walls 40, 48 are relatively smooth. Thus the walls 40, 48 entrain fluid and contribute to forming the vortex as the impeller 18 rotates. Entrainment also results from the fluid being injected from the impeller 16.

The inventor has tested an embodiment of the pump against a number of commercially available pumps and also against an embodiment of the pump of New Fluid '317. The graphs shown in FIGS. 9 to 15 were generated as a result of these tests. The embodiment of the pump, the Fluid '317 pump and the conventional pumps tested had a pump diameter of between about 120 mm and 180 mm.

Figure 10:
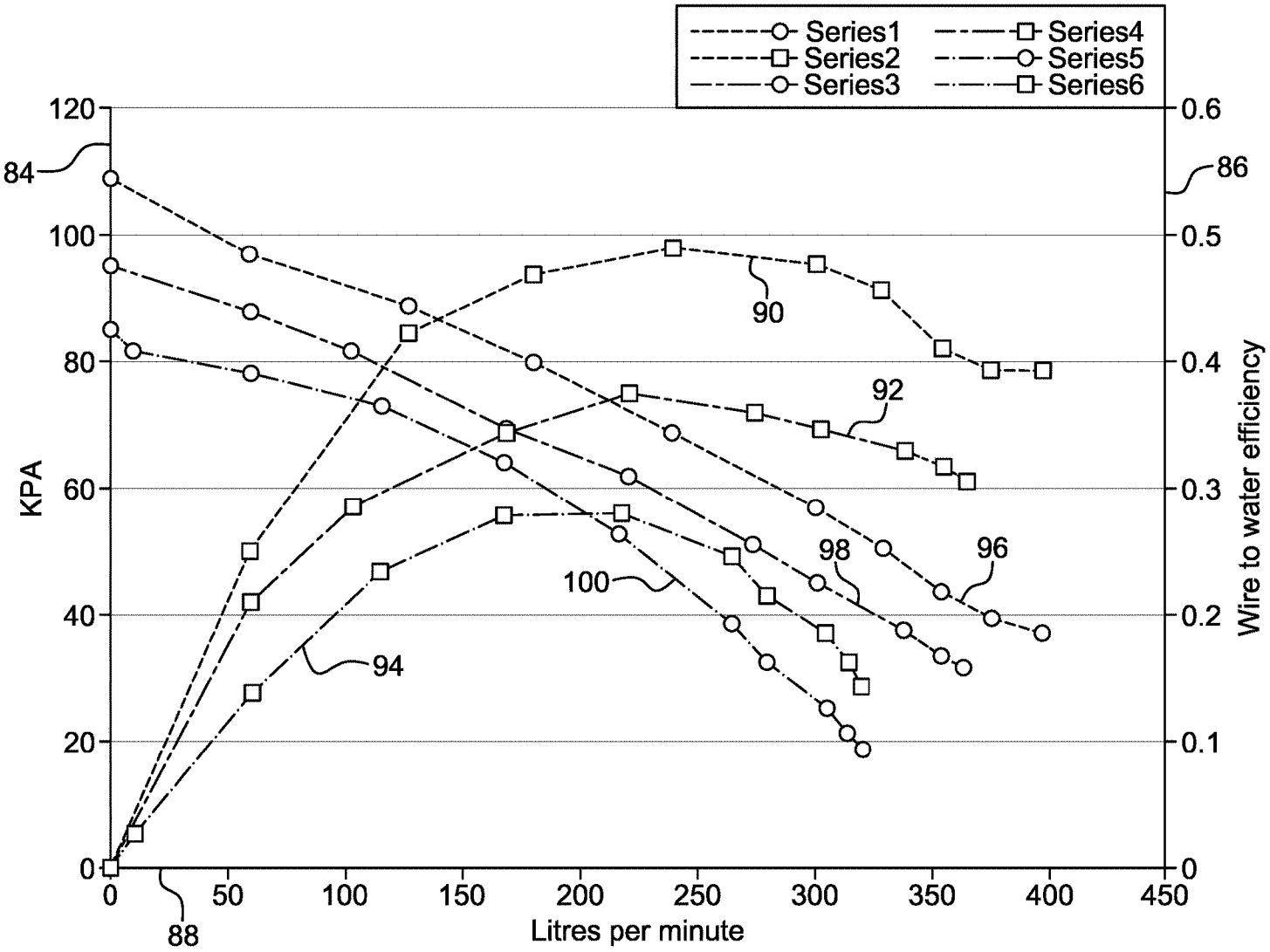
FIG. 10 shows a graph with flow rate and efficiency curves generated by commercially available pumps and by a pump described in New Fluid '317.

In FIG. 10, the graph has a pressure (KPA) axis 84, a "wire to water" or electrical efficiency axis 86 and a flow rate (litres/min) axis 88. In this graph, a line 90 is an efficiency curve of the Fluid '317 pump. Lines 92 and 94 are efficiency curves of two other conventional pumps available at the time of testing. A line 96 is a flow rate curve of the New Fluid '317 pump. Lines 98 and 100 are flow rate curves of the two other conventional pumps.

As is clear from the graph, the embodiment of New Fluid '317 has what would be considered better characteristics than the two other conventional pumps available at the time of testing.

Figure 11:
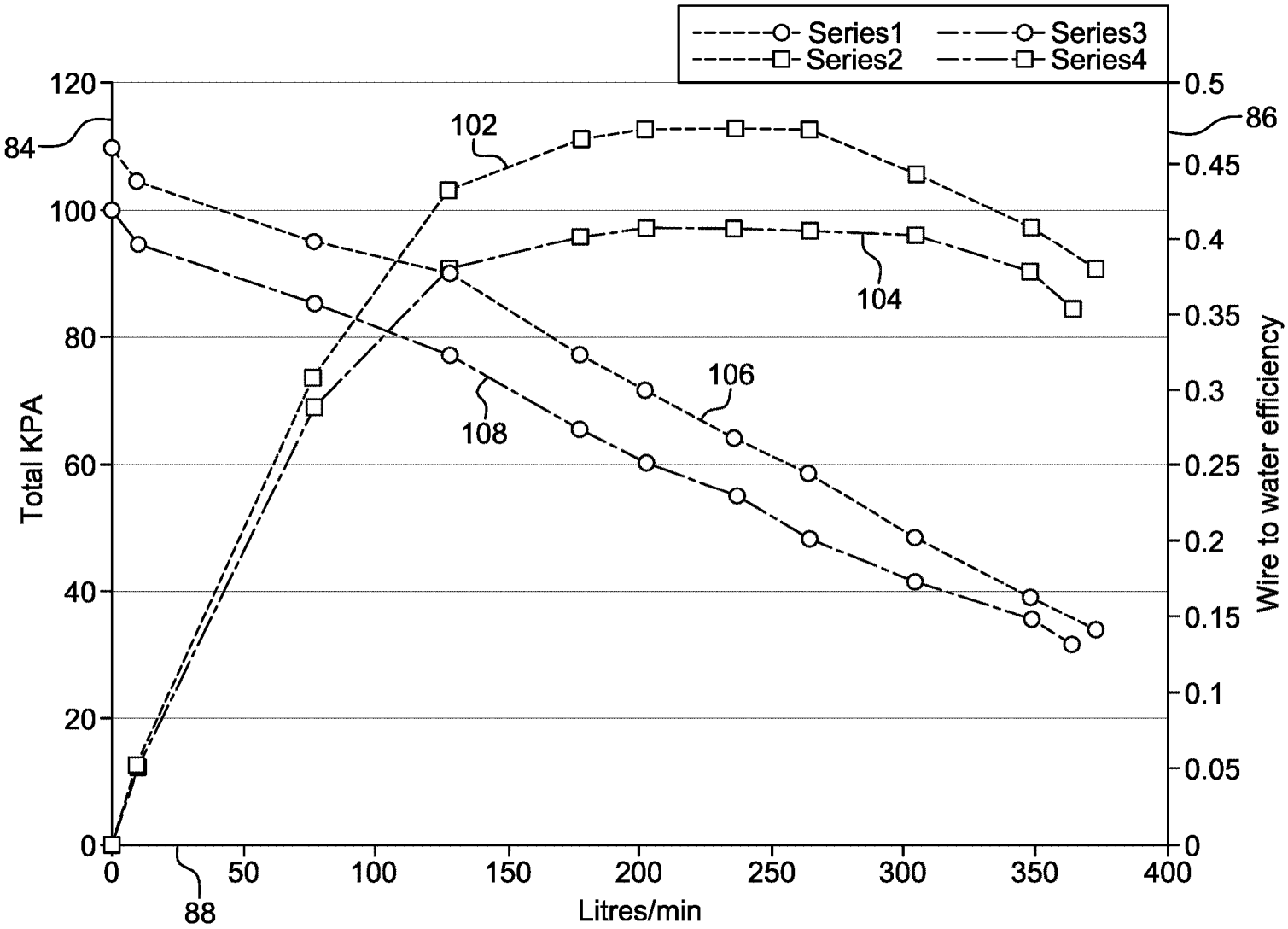
FIG. 11 shows a graph with flow rate and efficiency curves generated by an exemplary embodiment of a pump and the pump described in New Fluid '317.

In FIG. 11, like reference numerals refer to like components in FIG. 9. A line 102 is an efficiency curve of the tested embodiment of the present pump. A line 104 is an efficiency curve of the New Fluid '317 pump. A line 106 is a flow rate curve of the tested embodiment of the present pump. A One 108 is a flow rate curve of the New Fluid '317 pump.

Figure 12:
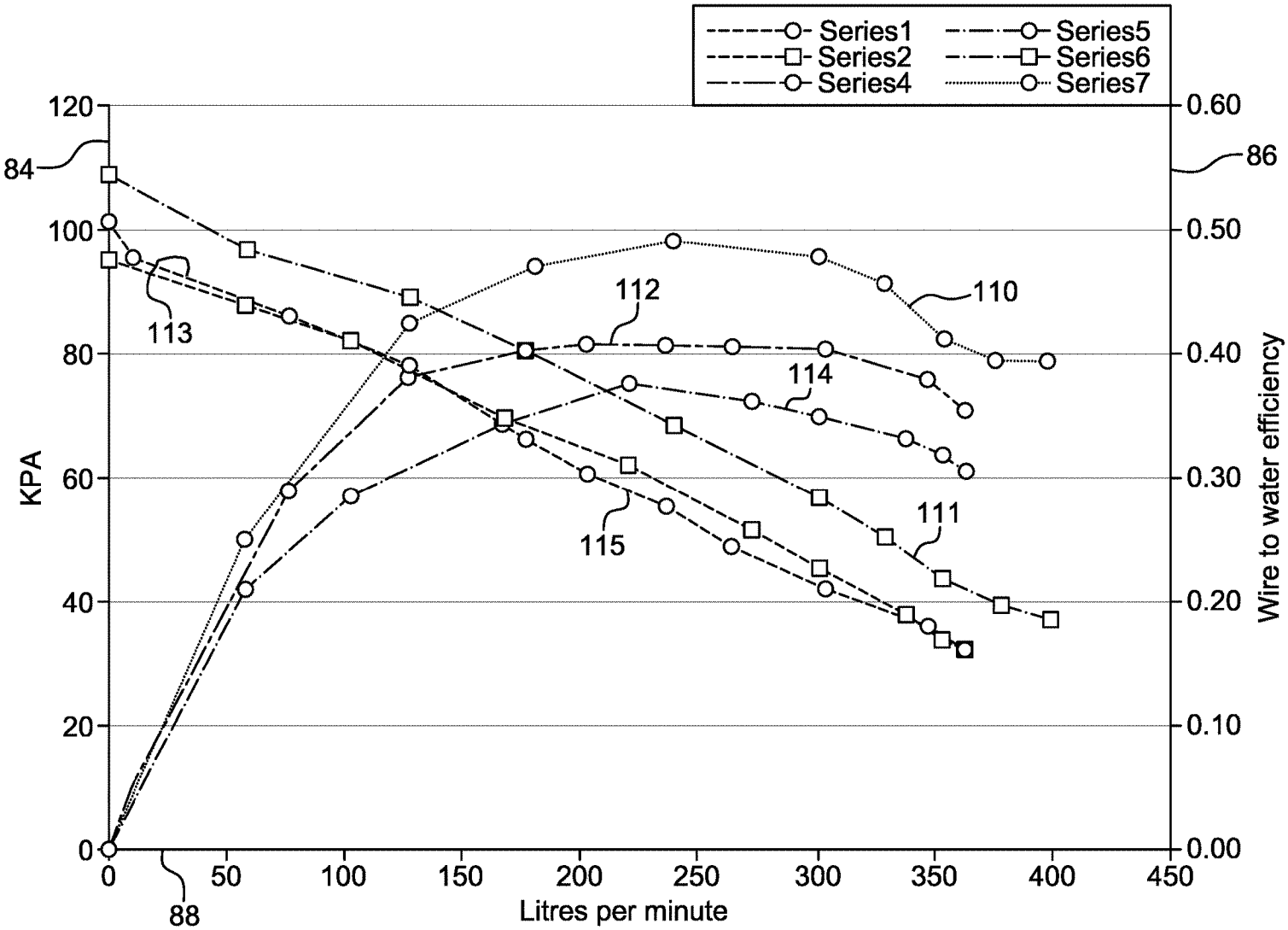
FIG. 12 shows a graph with flow rate and efficiency curves generated by an exemplary embodiment of a pump, the pump described in New Fluid '317 and by a commercially available pump.

In FIG. 12, like reference numerals refer to like components in FIGS. 10 and 11. A line 110 is an efficiency curve of the tested embodiment of the present pump. A line 112 is an efficiency curve of the New Fluid '317 pump. A line 114 is an efficiency curve of the better of the conventional pumps represented in FIG. 10. A line 111 is a flow rate curve of the tested embodiment of the present pump. A line 113 is a flow rate curve of the New Fluid '317 pump. A line 115 is a flow rate curve of the conventional pump.

Figure 13:
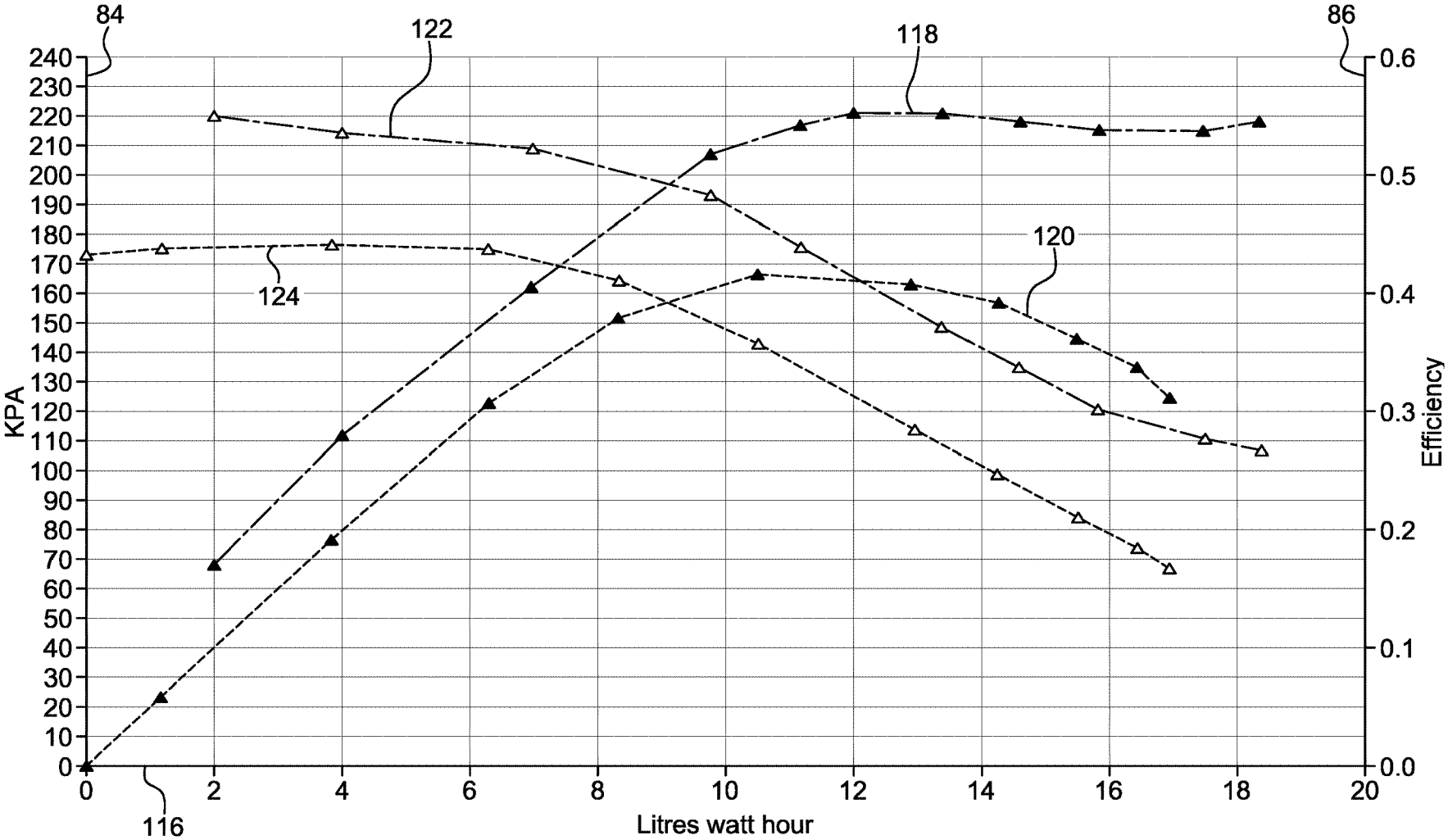
FIG. 13 shows a graph with litres per watt hour and efficiency curves generated by an exemplary embodiment of a pump and by a commercially available pump.

In FIG. 13, like reference numerals refer to like components in FIGS. 10 to 12. The graph includes a litres per watt hour axis 116 instead of the flow rate axis of the previous graphs. A line 118 is an efficiency curve of the tested embodiment of the present pump. A line 120 is an efficiency curve of a conventional pump available at the time of testing. A line 122 is a litres per watt hour curve of the tested embodiment of the present pump. A line 124 is a litres per watt hour curve of the conventional pump.

Figure 14:
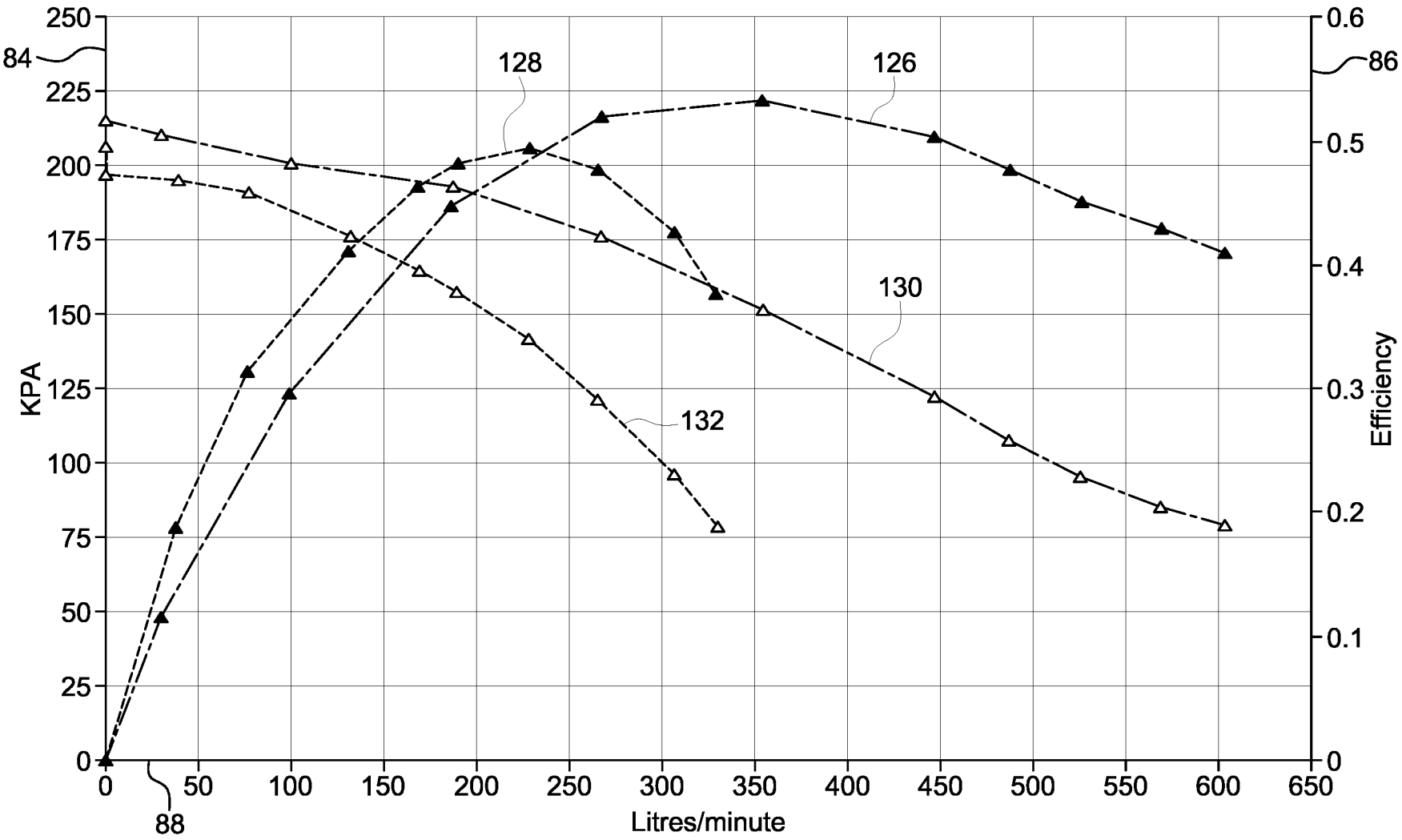
FIG. 14 shows a graph with flow rate and efficiency curves generated by an exemplary embodiment of a pump and by a further commercially available pump.

In FIG. 14, like reference numerals refer to like components in FIGS. 10 to 13. A line 126 is an efficiency curve of the tested embodiment of the present pump. A line 128 is an efficiency curve of a conventional pump available at the time of testing. A line 130 is a flow rate curve of the tested embodiment of the present pump. A line 132 is a flow rate curve of the conventional pump.

In addition to substantially the same pump size, the pumps tested all had a nominal speed of 2880 RPM.

In a number of industries, particularly industries such as those associated with swimming pool filtration end spas, an emerging trend is to require slower running of pumps. As a result, many major brands of pumps in such industries have a variable speed.

Slow running of a pump reduces pump efficiency due to a reduction in pressure. However, energy efficiency, stated as litres per watt hour is increased since it reduces the financial cost of pumping water. Energy efficiency is becoming regarded as more important than pump efficiency. One of the reasons for this is that most pumping applications only require a pumping head that is significantly less than that which the pump is capable of generating. It follows that pumps are increasingly selected for highest "energy efficiency".

Figure 15:
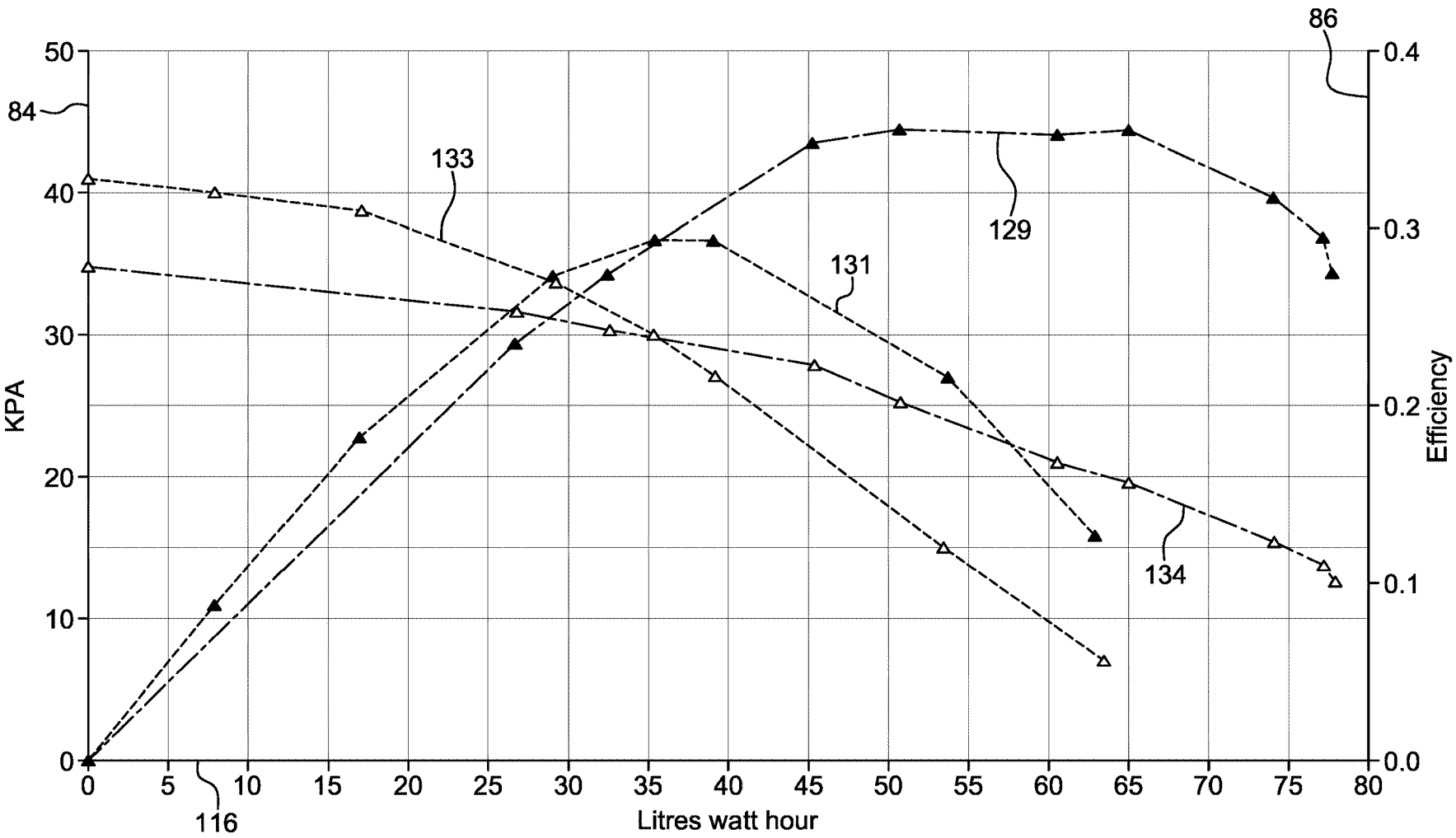
FIG. 15 shows a graph with litres per watt hour and efficiency curves generated by an exemplary embodiment of a pump and by a further commercially available pump.

In FIG. 15, like reference numerals refer to like components in FIGS. 10 to 14. A line 129 is an efficiency curve of the tested embodiment of the present pump operating at a reduced RPM. A line 131 is an efficiency curve of a conventional pump used in a luxury industry. A line 134 is a litres per watt hour curve of the tested embodiment of the present pump. A line 133 is a litres per watt hour curve of the conventional pump.

Figure 16:
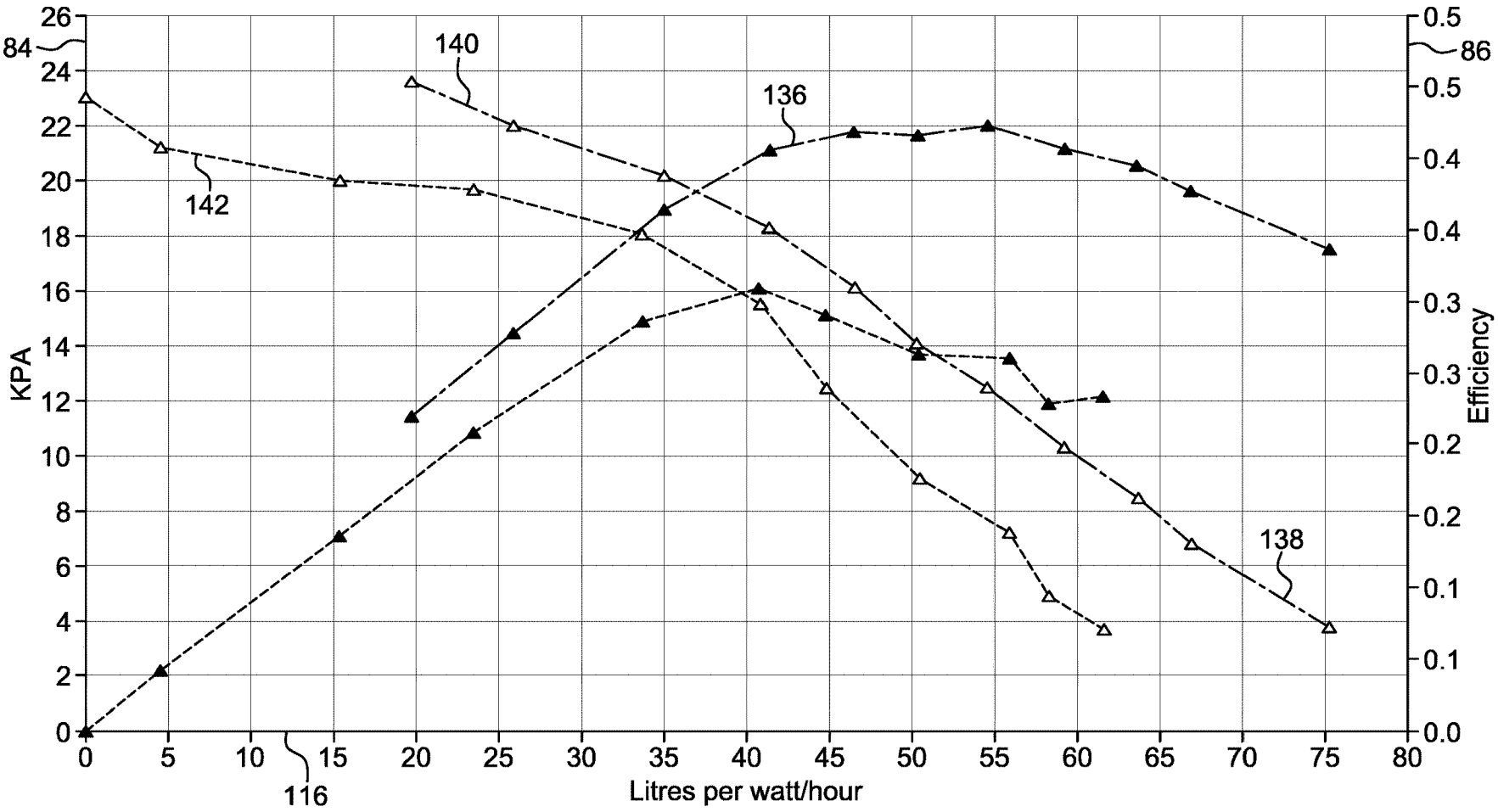
FIG. 16 shows a performance graph with litres per watt hour and efficiency curves generated by an exemplary embodiment of a pump and by a further commercially available pump.

In FIG. 16, like reference numerals refer to like components in FIGS. 10 to 15. A line 136 is an efficiency curve of the tested embodiment of the present pump operating at the reduced RPM. A line 138 is an efficiency curve of another conventional pump used in a luxury industry. A line 140 is a litres per watt hour curve of the tested embodiment. A line 142 is a litres per watt hour curve of the conventional pump.

Figure 17:
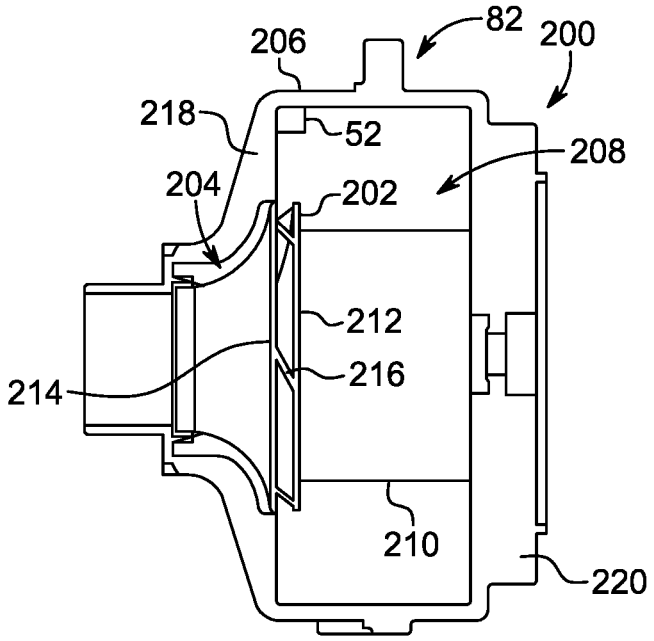
FIG. 17 shows a schematic side sectional view of a further exemplary embodiment of a pump.
Figure 18:
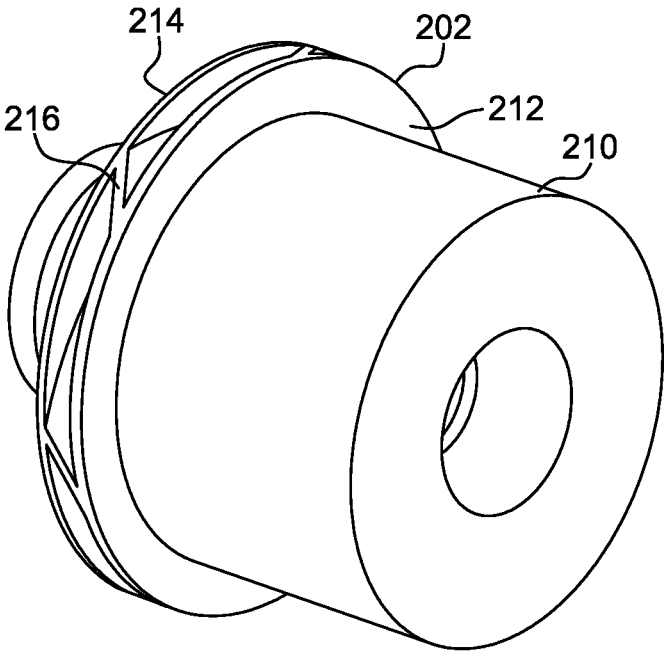
FIG. 18 shows a three dimensional view of an impeller of the pump of FIG. 17.

In FIGS. 17 and 18, reference numeral 200 generally indicates another exemplary embodiment of a pump. With reference to the preceding drawings, like reference numerals refer to like parts, unless otherwise specified.

The pump 200 illustrates a further possible location of an impeller 202. In this example, the impeller 202 is located partially in an inlet 204 of a pump housing 206, in use, fluid is fed or drawn into a zone 208 in which the vortex is generated.

The impeller 202 has a front wall 212, a rear wall 214 and a series of vanes 216 interposed between walls 212, 214, as with the impeller 16. A rear wall 218 of the housing 206 is shaped to accommodate the rear wall 214 of the impeller 16.

As described above, the generation of the vortex can result in cavitation in a zone or region about an axis of rotation of the vortex. Thus, the pump 200 includes an anti-cavitation formation in the form of a drum-like member 210 that extends from the front impeller wall 212 to a front wall 220 of the housing 206. As a result, the member 210 occupies a zone in which cavitation would be likely to occur. Thus, the presence of the drum-like member 210 in that zone inhibits cavitation.

The drum-like member 210 has a generally smooth, continuous outer surface in order to facilitate entrainment of the fluid about the member 210 as it rotates. As the member 210 rotates, fluid is entrained by the member 210. This contributes to the generation of the vortex. Entrainment of the fluid also results from the injection of fluid through the impeller and from rotation of the wall 212 that is relatively smooth.

It will be understood that in some embodiments a ratio of chamber diameter to drum-like member diameter can be used as a guideline for fabrication. In this embodiment, a pump chamber diameter of about 200 mm would suit a drum member diameter of about 100 mm. So selecting a drum with a diameter of about half that of the pump chamber can provide a useful result.

The inventor envisages that a person of ordinary skill in the art could carry out a certain amount of testing to determine other dimensions depending on the required pump characteristics.

Figure 19:
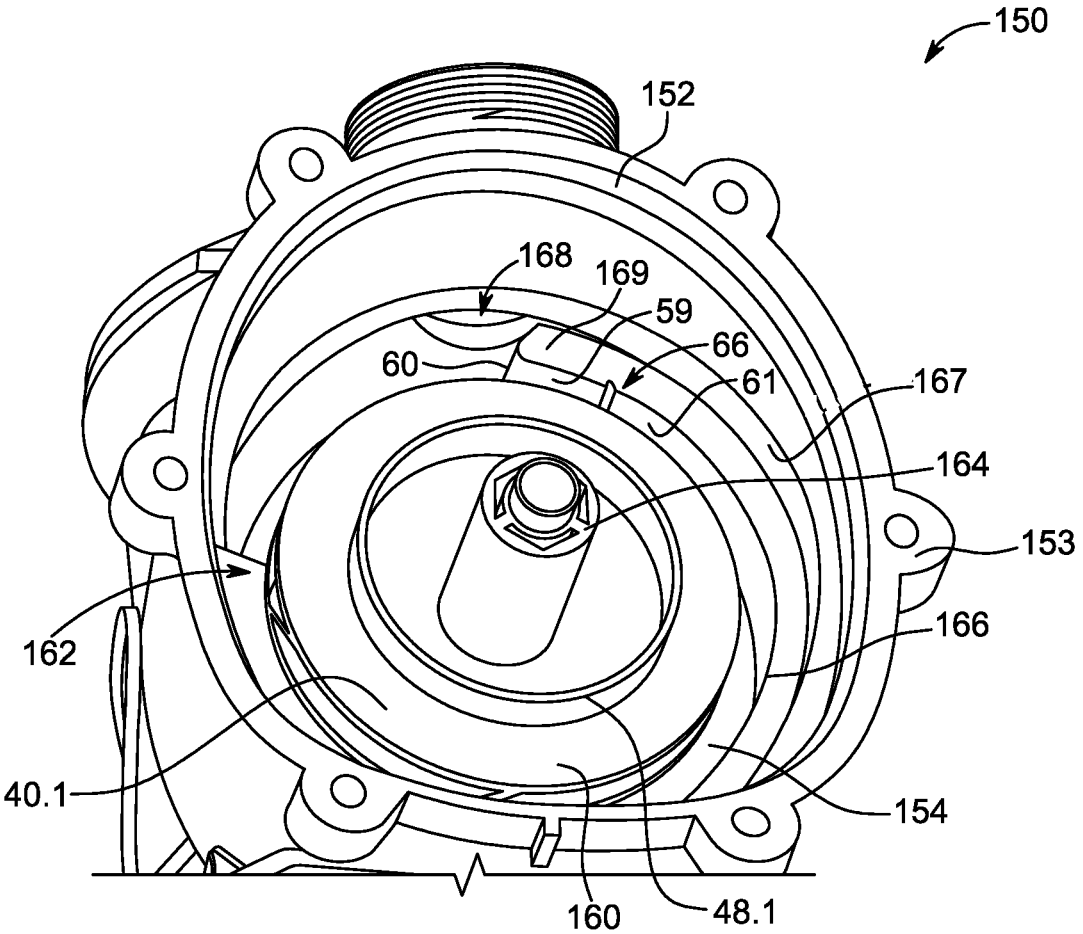
FIG. 19 shows a three-dimensional, internal view of a further exemplary embodiment of a pump.
Figure 20:
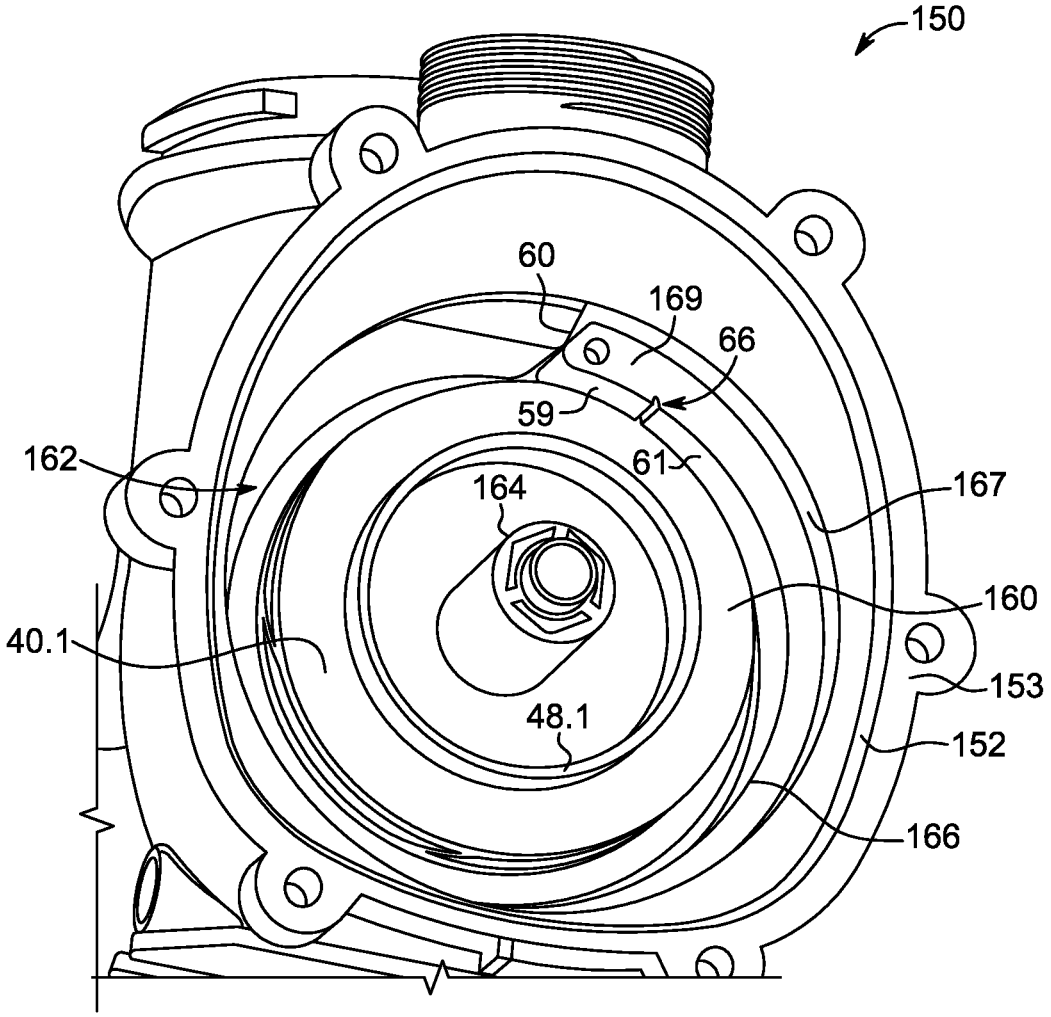
FIG. 20 shows a three-dimensional, internal view of a further exemplary embodiment of a pump.

In FIGS. 19 and 20, reference numeral 150 generally indicates a further exemplary embodiment of a pump. With reference to the preceding drawings, like reference numerals refer to like parts, unless otherwise specified.

Figure 21:
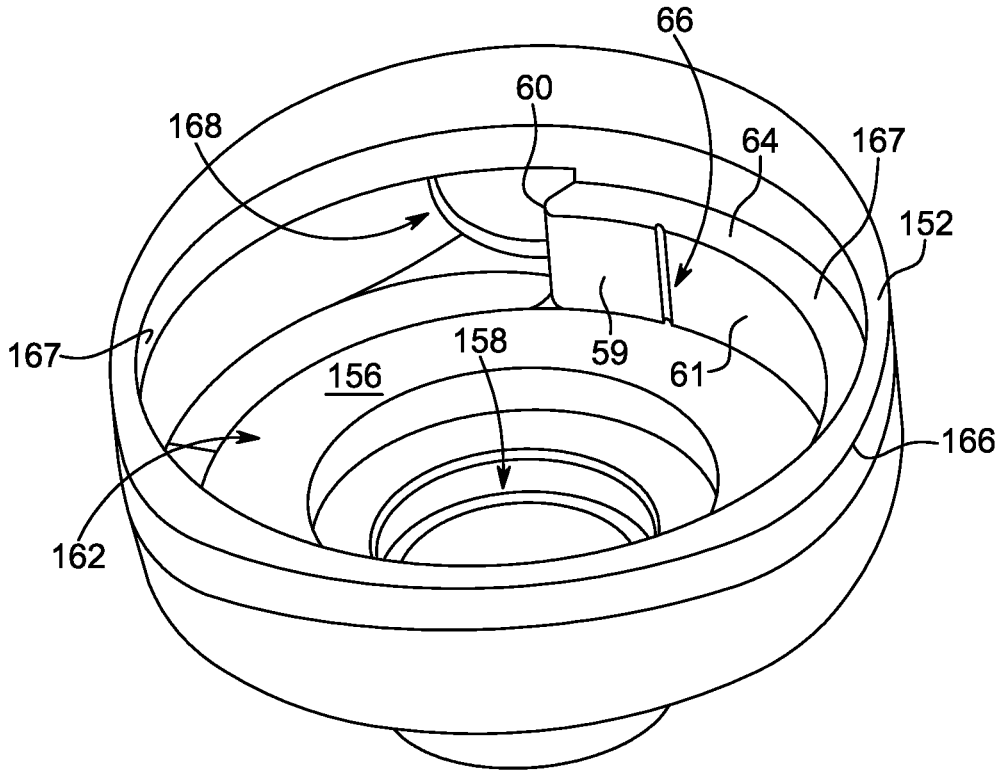
FIG. 21 shows a three-dimensional, internal view of a casing of the pump of FIG. 20.
Figure 22:
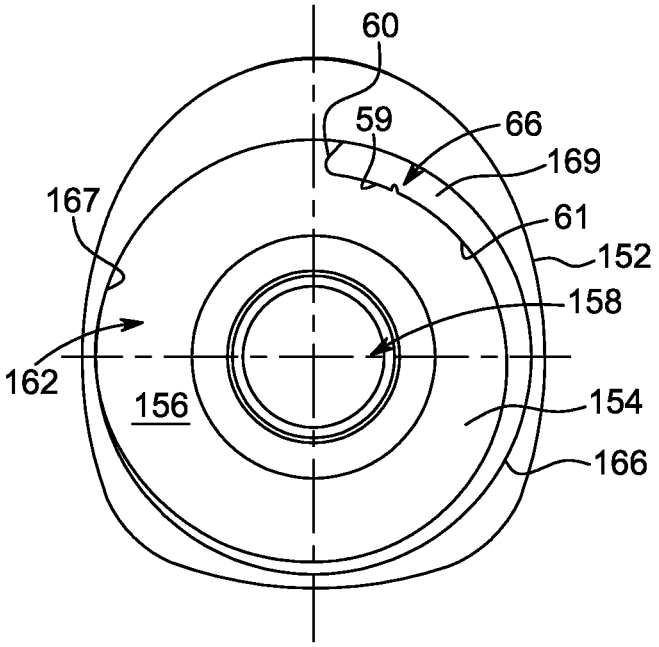
FIG. 22 shows a two-dimensional internal view of the casing of FIG. 21.

The pump 150 includes a casing 152 that is shown as a separate component in FIGS. 21 and 22. The casing 152 is configured to be positioned in an existing pump housing 153. The casing 152 includes a rear wall 154 with a substantially flat or planar internal rear surface 156 (FIG. 21). The rear wall 154 defines an inlet 158 that is shaped to accommodate an impeller 160 so that the impeller 160 can drive fluid into a pump chamber 162 defined by the casing 152, from the inlet 158 in order to set up the vortex. As described above, atmospheric pressure subsequently drives fluid from the inlet 150, through the impeller 160 and into the chamber 162 once the vortex is established. The impeller 160 can be mounted in the casing 152 and driven in a conventional manner. Thus, a drive shaft can be received through a cover, not shown, to engage a hub 154 of the impeller 150 so that the impeller 160 can be driven.

The Impeller 160 can be configured to replace an existing impeller of a conventional pump.

Thus, in use, an existing impeller can be removed. The casing 152 is inserted into the housing 153. The impeller 160 is arranged in the casing and connected to the drive shaft via the cover.

The casing 152 includes a sidewall 166 that extends generally orthogonally with respect to the rear wall 154 and defines an internal surface 167. An outlet 168 is arranged on the sidewall 166, in fluid communication with the pump chamber 162. A cover (not shown) can be fastened to the sidewall 166 to define a substantially flat or planar internal front surface. As with the pump 10, the internal surfaces define corners with an internal radius of less than about 10 mm.

The impeller 160 is similar to the impeller 16 in that a radial profile defines angles that are generally 90°. Thus, an overall radial profile of the chamber 162 defines angles that are generally 90°. The reasons for this are described with reference to the pump 10.

Instead of the insert 52, a vortex shaping formation 169 projects radially inwardly from the internal surface 167 in general axial alignment with the walls 40 of the impeller 160. The vortex shaping formation 169 forms an integral part of the casing 152 and has dimensions that are substantially the same as those of the insert 52. It follows that a solid body vortex can be set up in the chamber 162 in a manner similar to that described above. Common reference numerals are used in connection with the insert 52 and the formation 169.

The leading surface 60 of the vortex shaping formation 169 is positioned with respect to the outlet 168 so that a radial distance between a periphery of the impeller walls 40 and the internal surface 167 is greatest at the outlet 168. As a result, a static pressure in the diffusing zone is greatest at the outlet 168, for the reasons described with reference to the pump 10.

It is to be understood that the environment described with reference to FIG. 7 is also set up in the pump 150 and in various exemplary embodiments of the pump.

It is to be understood that the casing 152 can be configured to suit a variety of different pumps. For example, an external configuration of the casing 152 can be suited for housings of a variety of different pumps.

The inventor envisages that the casing 152 and the housing 153 can be in the form of an integral component. That embodiment would not be used for retrofitting existing pumps but would rather form the basis of a pump itself.

Figure 23:
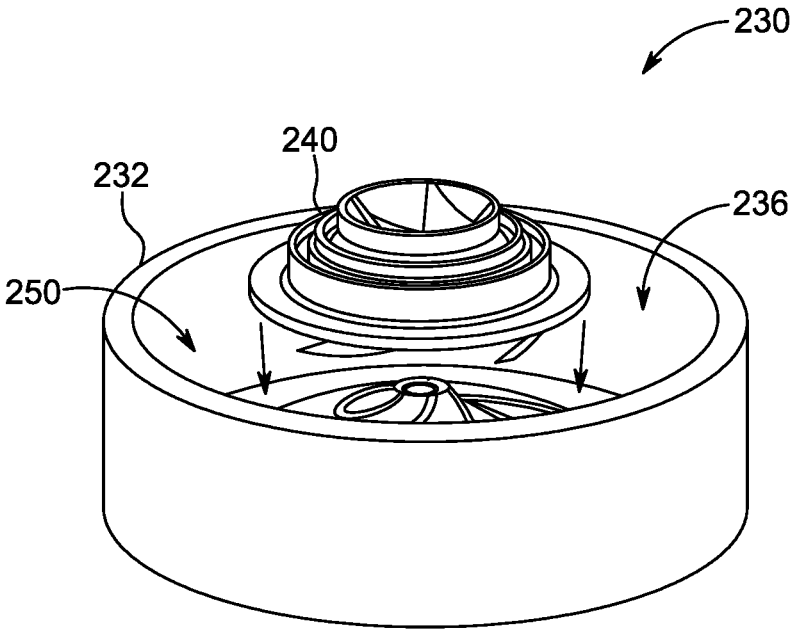
FIG. 23 shows a three-dimensional, partly exploded view of an exemplary embodiment of a pump.
Figure 24:
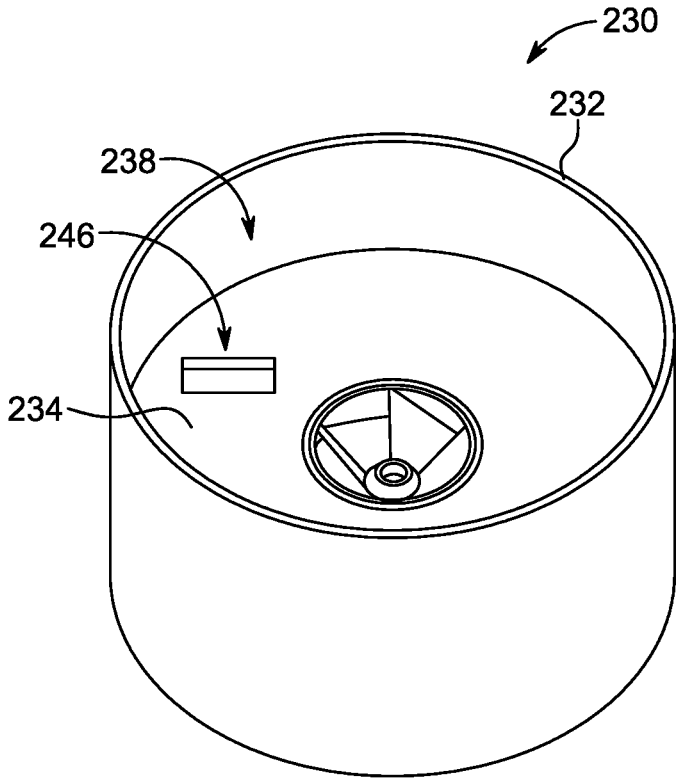
FIG. 24 shows a three-dimensional view from one side of the pump of FIG. 23.
Figure 25:
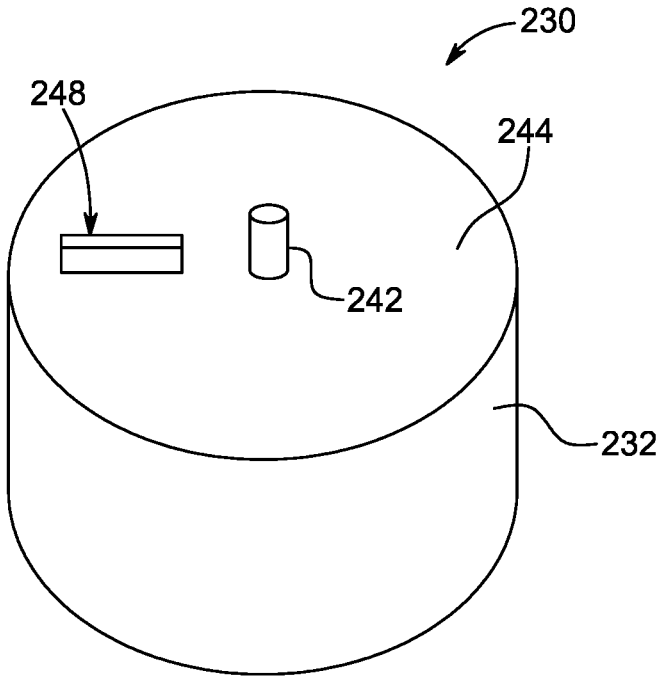
FIG. 25 shows a three-dimensional view from another side of the pump of FIG. 23.
Figure 26:
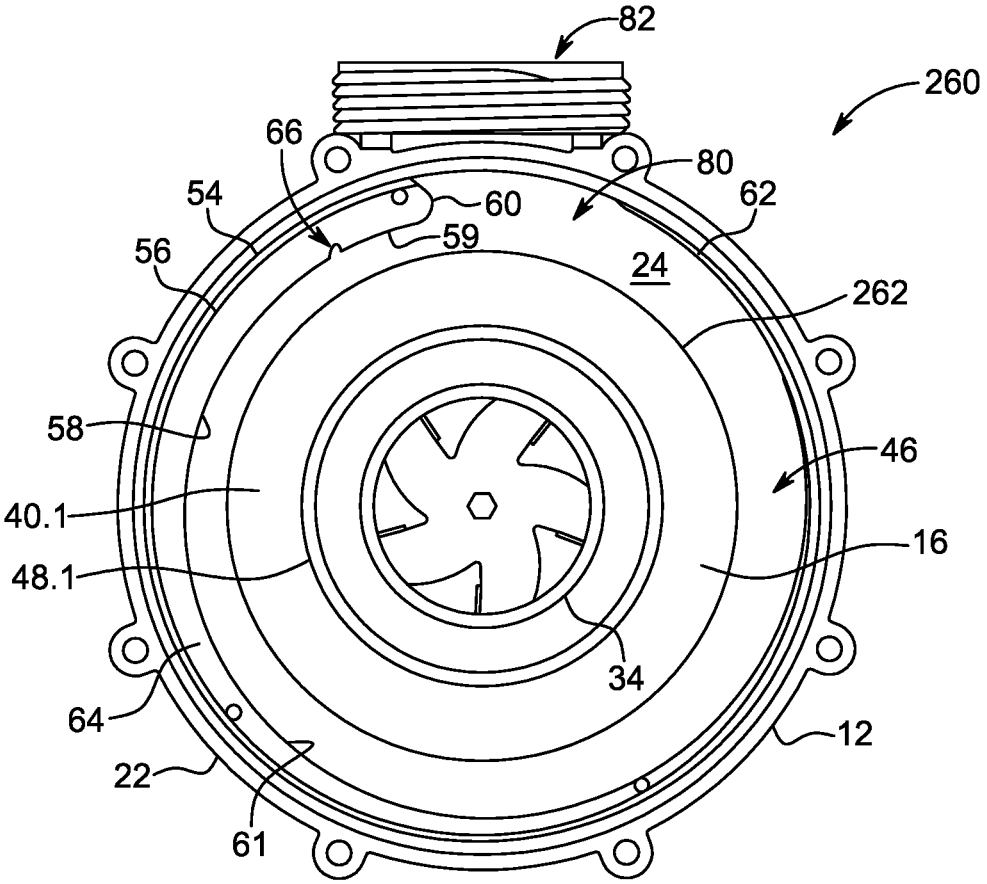
FIG. 26 shows a two-dimensional internal view of an exemplary embodiment of a pump.

In FIGS. 23 to 25, reference numeral 230 generally indicates an exemplary embodiment of a pump. With reference to the preceding drawings, like reference numerals refer to like parts, unless otherwise specified.

Conventional centrifugal pumps have a size limitation due to geometric ratio changes of internal volume to surface area around pump casing walls. Once a certain size is reached, there is insufficient pump casing wall area for inlets and outlets. The volume flow capability is not able to be accommodated by inlet and outlet cross sectional areas. It may be extremely difficult, if not impossible, to manufacture a conventional centrifugal pump as large as 4 metres in diameter. Generally, 3 metres is considered the upper limit.

As described above, the various exemplary embodiments do not make use of a physical or structural diffuser to generate the necessary static pressure. At lower speeds, structural diffusers are a hindrance to fluid flow. Over a certain size, it is difficult to achieve sufficient speed to avoid this problem with conventional diffusers.

The absence of a structural diffuser allows suitable or functional flow rates at sizes greater than available sizes of centrifugal pumps. It will be appreciated, however, that a peripheral speed of the vortex must be kept to within practical limits.

The pump 230 has a reservoir-like housing 232. The housing 232 is cast in ground. The housing 232 can be cast in concrete. The housing 232 can have a diameter greater than 4 metres.

A partition wall 234 divides the housing 232 diametrically. The housing 232 defines a pump chamber 236 (FIG. 23) and an inlet chamber 238 divided by the wall 234. The wall 234 defines an access opening 248 for inspection and maintenance.

An impeller 240 is mounted in the pump chamber 236. The impeller 240 is driven by a motor shaft 242 that extends through a roof 244 of the housing 232. The roof 244 defines an access opening 248 for inspection and maintenance.

A suitable outlet (not shown) can be provided on the housing 232, in the manner described earlier.

The impeller 240 and the housing 232 have a scaled up configuration of the embodiments described earlier. Thus, a vortex can be set up in a zone 250. A vortex shaping arrangement (not shown) can be provided in the pump chamber.

The inventor envisages that the pump 230 can run at speeds that are low compared to the flow rate. The inventor also envisages that a cost of constructing the pump 230 will be less than the cost of manufacturing a centrifugal pump with similar flow rate capacity. Reasons for this include the ability to use low cost materials such as concrete. It is envisaged that the pump 230 will be constructed on site. Thus, the cost of transport of a finished pump is avoided.

The inventor envisages that the impeller 240 can also be cast in situ of a suitable material. An example of such a material is concrete.

At least the vortex shaping mechanism distinguishes the various exemplary embodiments from the pump described in New Fluid '317.

In FIGS. 26 to 29, reference numeral 260 generally indicates an exemplary embodiment of a pump. With reference to the preceding drawings, like reference numerals refer to like components or parts, unless otherwise specified.

The pump 260 includes an impeller 262 that is different to the impellers described above.

The impeller 262 is configured to restrict flow of fluid out of the impeller 262 to allow pressure of fluid within the impeller 262 to build before the fluid is released into the pump chamber 46. As a result, flow through the impeller 262 is less than that of the previous embodiments, but is at a higher pressure or pumping head. It follows that this exemplary embodiment is useful for those applications that require higher pressure at a reduced flow rate.

Figure 27:
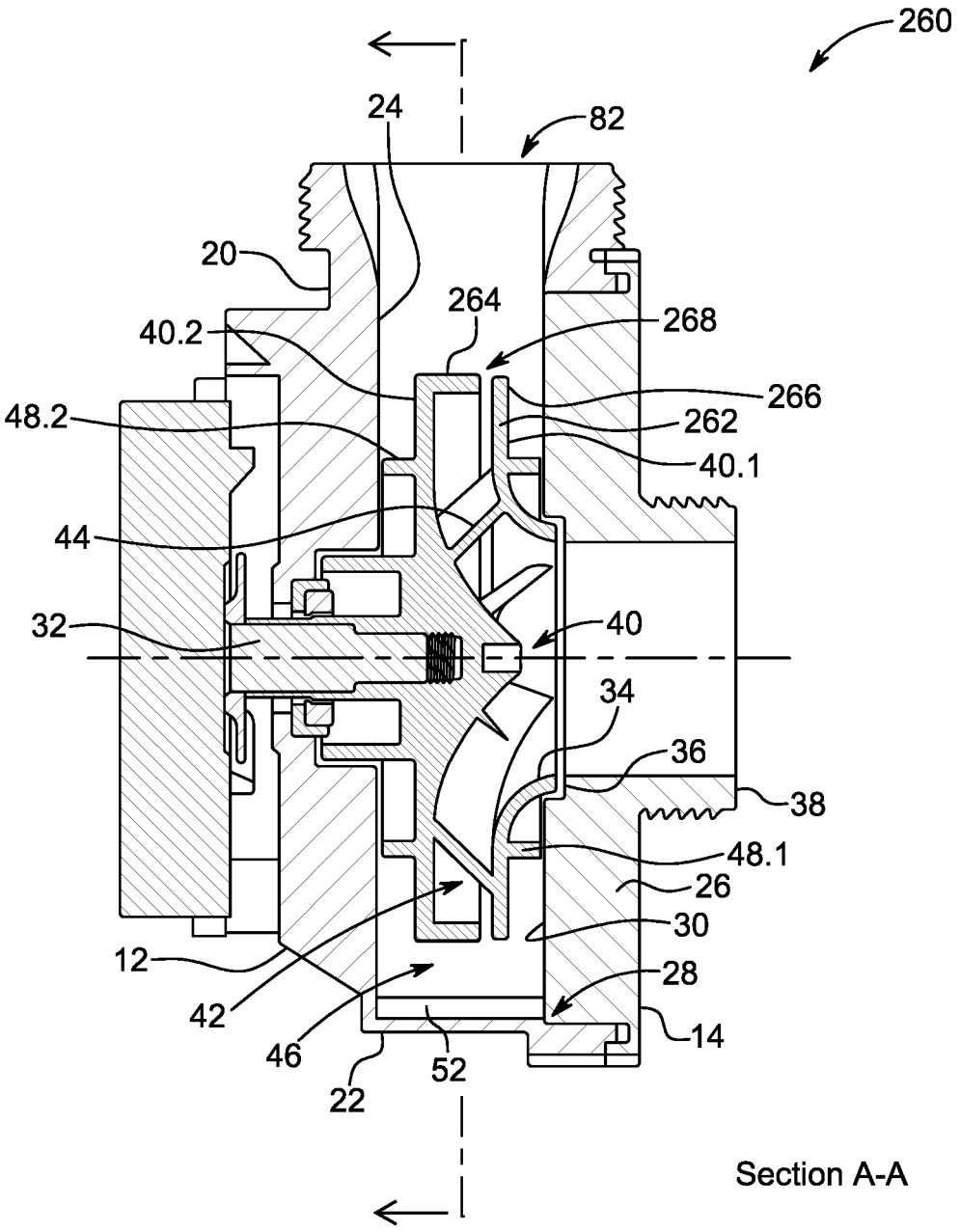
FIG. 27 shows a side sectional view, through A-A in FIG. 28, of the pump of FIG. 26.
Figure 28:
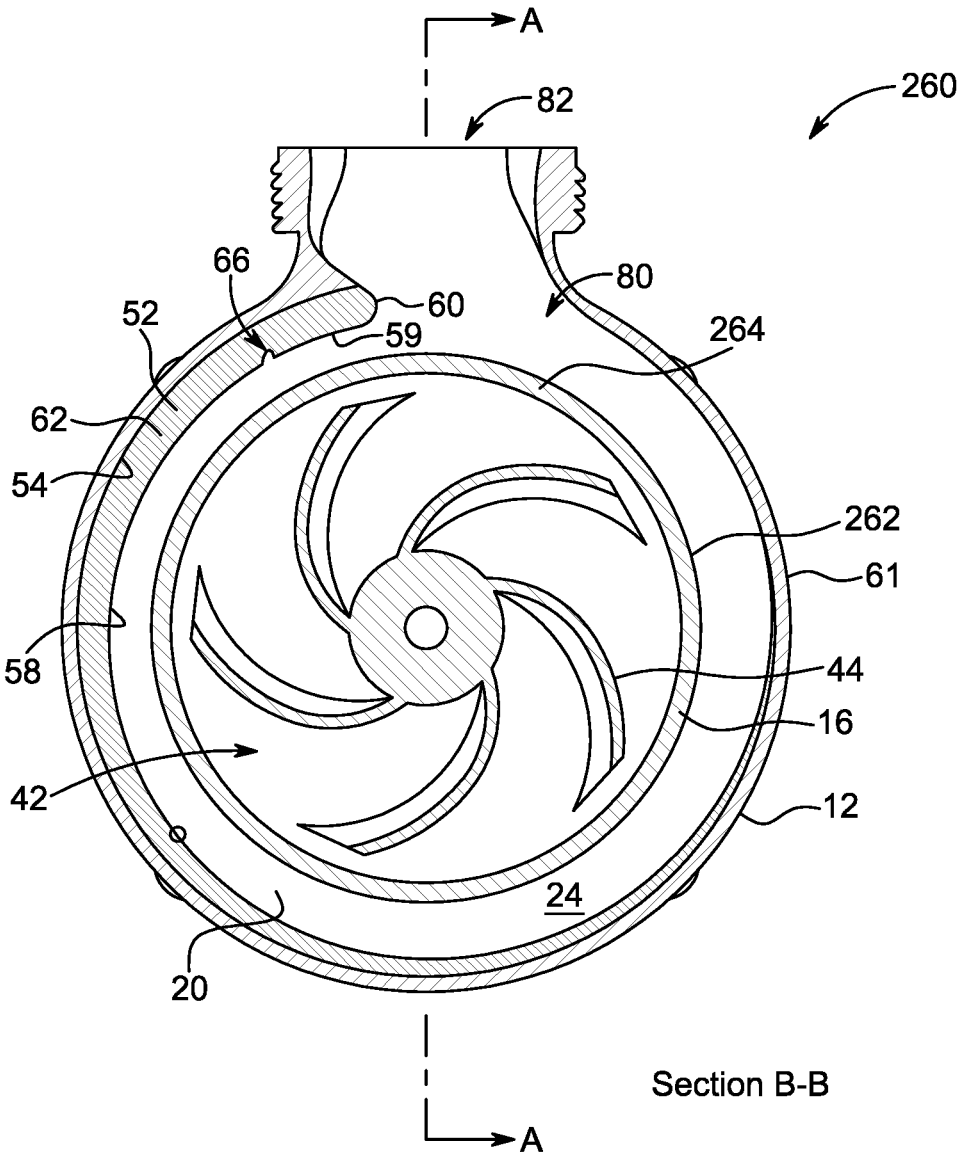
FIG. 28 shows a front sectional view, through B-B in FIG. 27, of the pump of FIG. 26.
Figure 29:
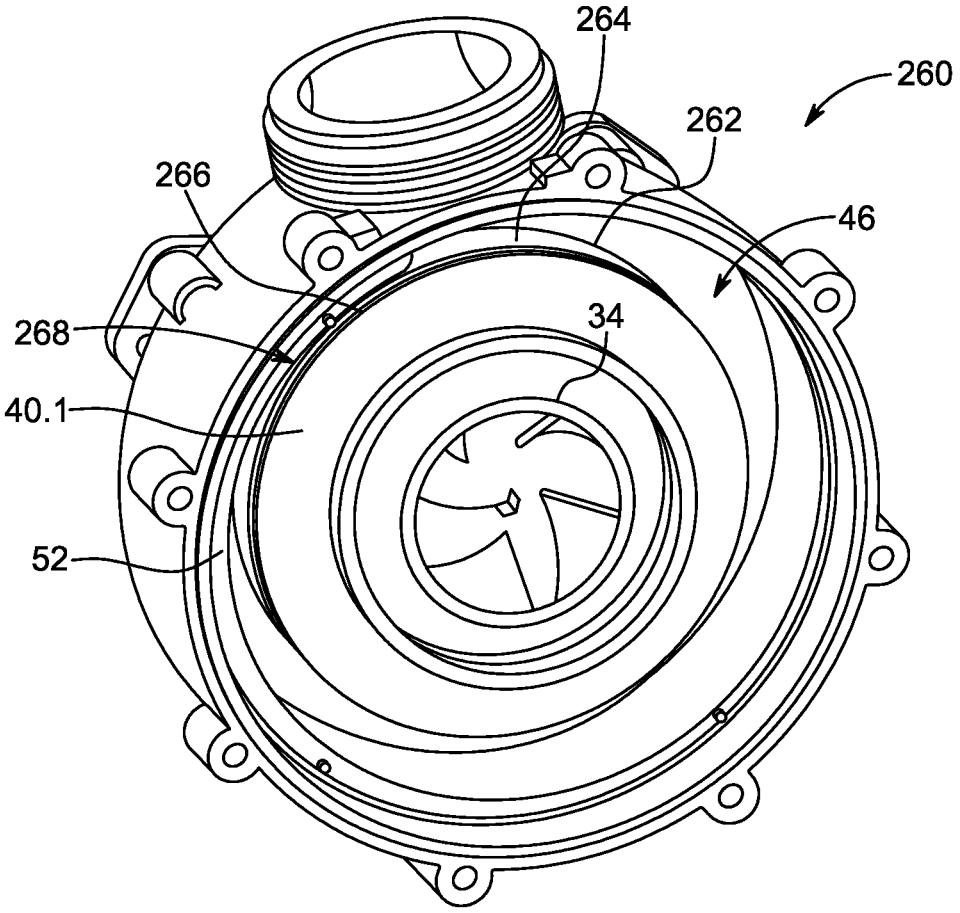
FIG. 29 shows an internal view of the pump of FIG. 26.

Restricting the flow rate can be achieved in a number of different ways. For example, as can be seen in FIG. 27, a peripheral lip or cover 264 extends axially from the impeller rear wall 40.2. The cover 264 and a peripheral edge 266 of the impeller front wall 40.1 together define an annular slot 268. Thus, as the impeller 262 rotates, fluid is restricted from being discharged from the impeller 262 to a certain extent. In this embodiment, the fluid is ejected or discharged radially from the impeller 262.

The slot 268 can vary in size, depending on the required characteristics. For example, a slot width of between 1 mm and 4 mm could be suitable for an impeller with a diameter of between about 105 mm and 110 mm. Such an impeller could have a gap between the front and rear walls 40.1 and 40.2 of between about 8 mm and 15 mm. The inlet formation could have a diameter of between about 40 mm and 50 mm.

As can be seen in the drawings, the cover 264 and the rear wall 40.2 are disposed generally at right angles to each other. Thus, as before, the pump chamber 46 is comprised of components that generally define angles of roughly 90 degrees relative to each other.

As described above, the walls 40, 48 entrain fluid and contribute to forming the vortex as the impeller 262 rotates. The cover 264 is also relatively smooth and so contributes to the entrainment of the fluid and the generation of the vortex.

It would be counter-intuitive to "cap" or "restrict" flow from an impeller of a conventional centrifugal pump. The reason for this is that the impeller needs to act directly on the fluid to build pressure in a diffuser. In contrast, the exemplary embodiments of the pump can benefit from restricted flow through the impeller to increase pumping head while reducing flow in certain pumping applications.

Figure 30:
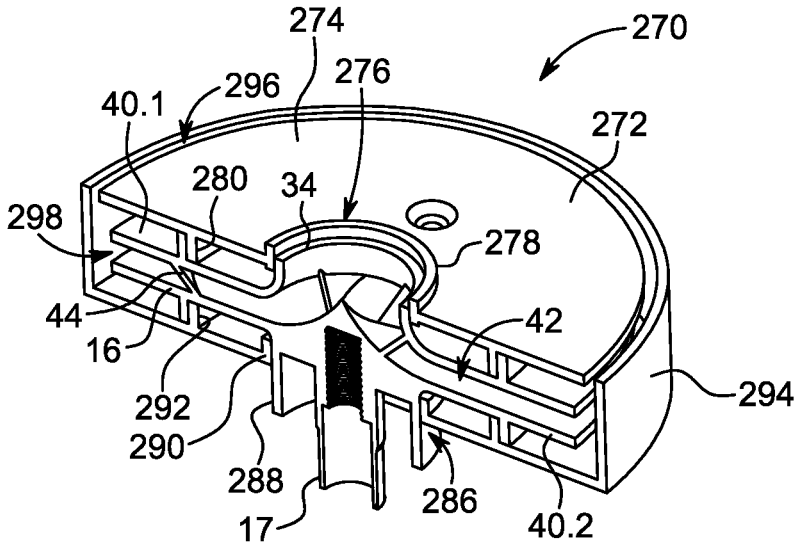
FIG. 30 shows a sectional, three-dimensional view of an embodiment of an impeller suitable for use with the pump of FIG. 26.
Figure 31:
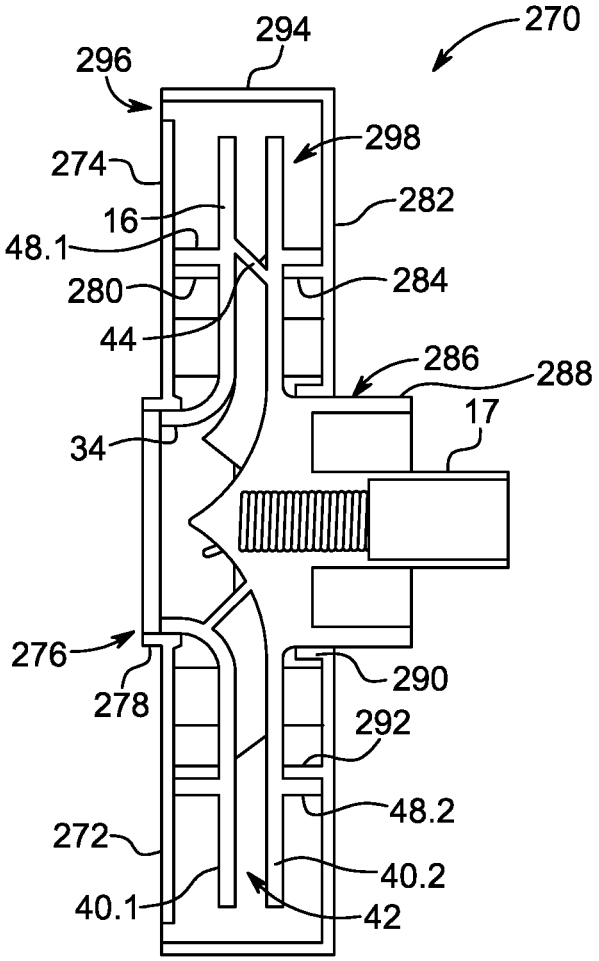
FIG. 31 shows a side sectional view of the impeller of FIG. 30.

In FIGS. 30 and 31, reference numeral 270 generally indicates an impeller assembly that can replace any of the impellers described above.

The impeller assembly 270 includes the impeller 16. Thus, reference numerals used previously in connection with the impeller 16 are used again to refer to like parts or components.

The impeller assembly 270 includes a cover arrangement having a front cover 272. The front cover 272 includes a flat body or wall 274. The cover 272 defines an aperture 276 with a peripheral flange 278 that is configured to fit onto the inlet formation 34 to mount the cover 272 onto the front impeller wall 40.1.

The cover 272 has a radius that is substantially the same as that of the impeller 16. An annular, axial well 280 extends rearwardly from the wall 274 to nest within the front wall 48.1. Thus, the front cover 272 can be fitted to the impeller front wall 40.1 with the peripheral flange 278 and the wall 280 between the inlet formation 34 and the wall 48.1.

The impeller assembly 270 includes a rear cover 282. The rear cover 282 has a radially extending wall 284. The wall 284 defines an aperture 286 to accommodate a hub 288 of the impeller 16. To that end, an internal peripheral flange 290 of the wall 284 engages the hub 288.

An annular, axial wall 292 extends forwardly from the wall 284 to nest within the rear wall 48.2. Thus, the rear cover 282 can be fitted to the impeller rear wall 40.2 with the peripheral flange 290 and the wall 284 between the hub 288 and the wall 382.

A diameter of the wall 284 is larger than the diameter of the impeller rear wall 40.2 by a predetermined extent. An annular lip or cover 294 extends generally axially from an outer periphery of the wall 284. The cover 294 terminates in alignment with the front wall 274 so that an annular gap or slot 296 that faces or opens axially and forwardly is defined.

Thus, an internal chamber 298 is defined by the impeller assembly 270 and the covers 272, 282, with an inlet of the chamber 298 being defined by the impeller 16 and an outlet being defined by the slot 296.

As the impeller assembly 270 rotates, fluid is driven into the chamber 298 in a conventional manner. The slot 296 is dimensioned to permit pressure to build up within the chamber 298. In other words, the slot 296 restricts the flow of fluid out of the chamber 298. Once the fluid is outside the chamber 298, a solid body vortex is set up around the impeller assembly 270, as described above.

As with the previous embodiments, the covers 272, 282 are of a relatively smooth material as is the hub 288. Furthermore, the wall 284 of the rear cover 282 is generally orthogonal to the hub 288. Thus, the fluid can be entrained about the impeller assembly 270 to encourage generation of the solid body vortex and to inhibit cavitation. A geometry of the impeller assembly 270 and the pump chamber 46, as described above, inhibits breakdown of the solid body vortex.

As set out above, it would be counter-intuitive to restrict the flow of fluid from an impeller to a diffuser in a conventional pump. The establishment and maintenance of a solid body vortex, in the manner described above, results in it being desirable to restrict flow of fluid into the solid body vortex in those applications where a reduction in flow and an increase in pumping pressure or head is required.

The inventor envisages that the slot can be located in any of a number of different positions. For example, the slot 268 can face axially forwardly or rearwardly, instead of radially as shown in FIG. 30. Also, the slot 296 can face axially rearwardly instead of forwardly. Also, the slot 296 can face radially.

Fluid that is discharged from the slot is entrained by the rotating impeller assembly 270 and is fed into the solid body vortex as a result of a pressure differential. As described above, this results in the fluid entering the diffusing zone 70 through diffusion across the interface 68, as described above.

The fact that flow is restricted through the impeller 10 allows an efficiency of a pump with the impeller assembly 270 to be improved at lower flow rates. For example, the inventor has found that the embodiment of the present pump used to generate the graphs in FIGS. 10 to 16 can have a lower efficiency than a conventional pump with similar physical characteristics at lower flow rates. For example, see FIGS. 14 and 15. The inventor has found that when the impeller 202 or the impeller assembly 270 is used, the efficiency curve of the pump can be higher than the efficiency curve of the conventional pump along the entire axis 88, 116.

In this specification, the term "solid body vortex" is used. This is a term that has its equivalence in "rotational vortex" and "forced vortex". These are terms that would be understood by a person of ordinary skill in the field of pumping and fluid dynamics generally.

The generation of the solid body vortex in the pump casing provides functionality to the various exemplary embodiments of the pump. Substantially no shear exists between water molecules in a solid body vortex. It follows that the water molecules "line up", spoke fashion, both radially and axially within the solid body vortex. As a result, angular velocity of the fluid in the solid body vortex is consistent within the solid body vortex.

The principles of solid body vortices teach that the solid body state can be maintained indefinitely provided sufficient energy is imparted to the fluid and the fluid is retained in a structure that has a geometry that encourages the generation of a solid body vortex.

In various exemplary embodiments, the impeller imparts all the energy required for establishing and maintaining the vortex. Once the solid body vortex is generated, a relatively low pressure in the vortex causes fluid to be driven into the pump casing and into the vortex under atmospheric pressure. Fluid enters the diffusing volume through diffusion in order to maintain volumetric equilibrium in the vortex. That generates pumping pressure or head in the diffusing volume.

It is desirable that the solid body vortex has generally flat sides in planes that are orthogonal to an axis of rotation of the vortex. Thus, in various exemplary embodiments, the casing and the impeller may be configured to define a pump chamber with a profile that is shaped so that a solid, annular body of fluid can rotate within the pump chamber.

For example, in one embodiment, the impeller may be generally cylindrical or disc-shaped with a circumferential periphery. Thus, the casing and the impeller may be configured so that a solid, annular body of fluid can rotate in a volume that is at least located radially outwardly of the impeller and in fluid communication with the impeller. An external circumferential periphery of the volume may thus be defined by the principles of solid-body vorticity that would apply to the body of fluid in that volume. The diffusing volume may thus have an internal circumferential periphery that is defined by the fluid interface.

As mentioned above, the fluid in the solid-body vortex has a constant RPM, radially across the vortex. This results in a speed of the vortex at the interface that is higher than a speed of the fluid in the diffusing volume at the interface. This difference in speeds and the principles of solid-body vorticity serve to maintain the solid-body vortex and the fluid in the diffusing volume as separate bodies of fluid. Thus, fluid can only substantially move across the interface by diffusion.

Counter-intuitively, the principles of solid-body vorticity serve to maintain a shape of the solid-body vortex, inhibiting fluid from entering the diffusing volume under centripetal force.

Various exemplary embodiments of a pump therefore comprise a pump casing that defines a pump chamber, the pump casing having an inlet and an outlet;

an impeller arranged with respect to the pump chamber to displace fluid from the inlet into the pump chamber; and a vortex shaping mechanism arranged in the pump chamber and configured to constrain fluid within the pump chamber into a rotational flow pattern about a rotational axis, at least the casing and the vortex shaping mechanism being configured so that a portion of the fluid is encouraged to establish a sold body vortex, with an outer periphery of the solid body vortex being determined by the vortex shaping mechanism, and a portion of the fluid defining a diffusion zone in fluid communication with the outlet such that fluid can diffuse across a fluid interface defined between the solid body vortex and the diffusing volume to generate a pumping pressure at the outlet.

The vortex shaping mechanism may be configured to constrain fluid within the pump chamber into the rotational flow pattern. The casing, the vortex shaping mechanism and the impeller may be configured so that the portion of the fluid is encouraged to define a solid body vortex.

The pump casing may have a front wall, a rear wall and a sidewall interposed between the front and rear walls. The front and rear walls may define substantially flat internal surfaces. The inlet may be arranged on one of the front and rear walls and the outlet may be arranged on the sidewall. The sidewall and the front and rear walls may intersect at a corner with a radius of curvature of less than 10 mm.

The impeller may be a generally disc-shaped impeller mounted in the casing to be driven rotationally about the rotational axis and may have a pair of opposed, generally flat walls and a radial profile with a periphery that is generally flat and parallel to an axis of rotation of the impeller.

An outlet of the impeller may be configured so that a flow of fluid out of the impeller is restricted to generate a buildup of fluid pressure within the impeller. The outlet of the impeller may be defined by a circumferential slot that opens axially. Instead, the outlet of the impeller is defined by a circumferential slot that opens radially.

The pump may include a cover arrangement in which the impeller is arranged. The cover arrangement may define a flow restriction aperture so that flow from the impeller into the pump chamber is restricted to generate a buildup of fluid pressure within the impeller.

The vortex shaping mechanism may be defined by an insert that is configured for location on an internal surface of the sidewall.

The insert and the internal surface of the sidewall may be configured so that the insert can be positioned on the internal surface in general axial alignment with the impeller.

The insert may have an outer side that is shaped to correspond with the internal surface of the sidewall. An inner side may be spaced from the outer side at a leading surface and may taper to the outer side at a trailing end.

The insert may have a leading portion of a constant radius, measured from the rotational axis, along an arc length and a trailing portion with an increasing radius from the leading portion to the trailing end.

The leading surface may have a curved radial profile to provide flow transition while inhibiting cavitation.

The outer and inner sides and the leading surface may be interposed axially between generally flat, radial sides.

The vortex shaping mechanism may be at least part of a vortex shaping formation that forms an integral part of the casing and projects radially into the pump chamber.

The vortex shaping formation may have an inner side that is radially spaced from an internal surface of the sidewall at a leading surface and may taper to the internal surface at a trailing end.

The leading surface may have a curved radial profile to provide flow transition while inhibiting cavitation.

The vortex shaping formation may have at least one generally flat, radial side.

A leading portion of the inner side may have a constant radius, measured from the axis of rotation to define the vortex shaping mechanism. A remaining, trailing portion of the inner side may have a continuously increasing radius to taper to the internal surface at the trailing end.

Various exemplary embodiments of a pump assembly comprise a pump casing that defines a pump chamber, the pump casing having an inlet and an outlet and being configured to be arranged within a pump housing;

an impeller arranged with respect to the pump chamber to displace fluid from the inlet into the pump chamber; and a vortex shaping mechanism arranged in the pump chamber and configured to constrain fluid within the pump chamber into a rotational flow pattern about a rotational axis, at least the casing and the vortex shaping mechanism being configured so that a portion of the fluid is encouraged to define a solid body vortex, with an outer periphery of the solid body vortex being determined by the vortex shaping mechanism, and a portion of the fluid defining a diffusion zone in fluid communication with the outlet such that fluid can diffuse across a fluid interface between the solid body vortex and the diffusing volume to generate a pumping pressure at the outlet.

Various exemplary embodiments of a vortex shaping mechanism for a pump that has a pump casing that defines a pump chamber, the pump casing having an inlet and an outlet and an impeller arranged with respect to the pump chamber to displace fluid from the inlet into the pump chamber, are suitable for arrangement in the pump chamber and are configured to constrain fluid within the pump chamber into a rotational flow pattern about a rotational axis so that a portion of the fluid is encouraged to establish a solid body vortex, with an outer periphery of the solid body vortex being determined by the vortex shaping mechanism, and a remaining portion of the fluid defining a diffusion zone in fluid communication with the outlet such that fluid can diffuse across a fluid interface between the solid body vortex and the diffusion zone to generate a pumping pressure at the outlet.

Throughout the specification, including the claims, the following interpretations and definitions are to be followed:

a. Use of words that indicate orientation or direction is not to be considered limiting. Thus, words such as "front", "rear", "side", "forward", "rearward", "back", "towards" and synonyms, antonyms and derivatives thereof have been selected for convenience only and are not to be regarded as limiting.
b. "Axial" refers to an axis of rotation either of an impeller or of a solid body vortex, where the impeller does not rotate.
c. "Radial" refers to a line or axis extending generally orthogonally with respect to the axis of rotation described above.
d. "Leading" when used with reference to a component in a flow of fluid refers to that part or portion facing into the flow of fluid.
e. "Trailing" when used with reference to a component in a flow of fluid refers to that part or portion opposite the leading part or portion.
f. "Fluid" refers to both gaseous and liquid states of matter.
g. "Impeller" refers to any component or assembly of components in a pump that is capable of physically driving fluid from a pump inlet and into a pump casing or housing.

Throughout the specification, including the claims, where the context permits, the term "comprising" and variants thereof such as "comprise" or "comprises" are to be interpreted as including the stated integer or integers without necessarily excluding any other integers.

It is to be understood that the terminology employed above is for the purpose of description end should not be regarded as limiting. The described embodiments are intended to be illustrative of the invention, without limiting the scope thereof. The invention is capable of being practised with various modifications and additions as will readily occur to those skilled in the art.

Various substantially and specifically practical and useful exemplary embodiments of the claimed subject matter, are described herein, textually and/or graphically, including the best mode, if any, known to the inventors for carrying out the claimed subject matter. Variations (e.g., modifications and/or enhancements) of one or more embodiments described herein might become apparent to those of ordinary skill in the art upon reading this application. The inventors expect skilled artisans to employ such variations as appropriate, and the inventors intend for the claimed subject matter to be practiced other than as specifically described herein. Accordingly, as permitted by law, the claimed subject matter includes and covers all equivalents of the claimed subject matter and all improvements to the claimed subject matter. Moreover, every combination of the above described elements, activities, and all possible variations thereof are encompassed by the claimed subject matter unless otherwise clearly indicated herein, clearly and specifically disclaimed, or otherwise clearly contradicted by context.

The use of any and all examples, or exemplary language (e.g., "such as") provided herein, is intended merely to better illuminate one or more embodiments and does not pose a limitation on the scope of any claimed subject matter unless otherwise stated. No language in the specification should be construed as indicating any non-claimed subject matter as essential to the practice of the claimed subject matter.

Thus, regardless of the content of any portion (e.g., title, field, background, summary, description, abstract, drawing figure, etc.) of this application, unless clearly specified to the contrary, such as via explicit definition, assertion, or argument, or clearly contradicted by context, with respect to any claim, whether of this application and/or any claim of any application claiming priority hereto, and whether originally presented or otherwise:

a. there is no requirement for the inclusion of any particular described or illustrated characteristic, function, activity, or element, any particular sequence of activities, or any particular interrelationship of elements;
b. no characteristic, function, activity, or element is "essential";
c. any elements can be integrated, segregated, and/or duplicated;
d. any activity can be repeated, any activity can be performed by multiple entities, and/or any activity can be performed in multiple jurisdictions; and
e. any activity or element can be specifically excluded, the sequence of activities can vary, and/or the interrelationship of elements can vary.

The use of the terms "a", "an", "said", "the", and/or similar referents in the context of describing various embodiments (especially in the context of the following claims) are to be construed to cover both the singular and the plural, unless otherwise indicated herein or clearly contradicted by context. The terms "comprising," "having." "including," and "containing" are to be construed as open-ended terms (i.e., meaning "including, but not limited to,") unless otherwise noted.

Moreover, when any number or range is described herein, unless clearly stated otherwise, that number or range is approximate. Recitation of ranges of values herein are merely intended to serve as a shorthand method of referring individually to each separate value falling within the range, unless otherwise indicated herein, and each separate value and each separate subrange defined by such separate values is incorporated into the specification as f it were individually recited herein. For example, if a range of 1 to 10 is described, that range includes all values therebetween, such as for example, 1.1, 2.5, 3.335, 5, 6.179, 8.9999, etc., and includes all subranges therebetween, such as for example, 1 to 3.65, 2.8 to 8.14, 1.93 to 9, etc.

Accordingly, every portion (e.g., title, field, background, summary, description, abstract, drawing figure, etc.) of this application, other than the claims themselves, is to be regarded as illustrative in nature, and not as restrictive, and the scope of subject matter protected by any patent that issues based on this application is defined only by the claims of that patent.

The invention claimed is:

1. A pump that comprises:

a pump casing that defines a pump chamber, the pump casing having an inlet and an outlet;

an impeller arranged with respect to the pump chamber to displace fluid from the inlet into the pump chamber; and a vortex shaping mechanism arranged in the pump chamber and configured to constrain fluid within the pump chamber into a rotational flow pattern about a rotational axis, at least the casing and the vortex shaping mechanism being configured so that a portion of the fluid is encouraged to establish a solid body vortex, with an outer periphery of the solid body vortex being determined by the vortex shaping mechanism, and a remaining portion of the fluid filling a diffusion zone in fluid communication with the outlet such that fluid can diffuse across a fluid interface defined between the solid body vortex and the diffusion zone to generate a pumping pressure at the outlet;

said vortex shaping mechanism being configured to constrain fluid within the pump chamber into the rotational flow pattern, the casing, the vortex shaping mechanism and the impeller being configured so that the portion of the fluid is encouraged to define a solid body vortex; and wherein said pump casing has a front wall, a rear wall and a sidewall interposed between the front and rear walls, the front and rear walls defining substantially flat internal surfaces, the inlet being arranged on one of the front and rear walls and the outlet being arranged on the sidewall, the sidewall and the front and rear walls intersecting at a corner with a radius of curvature of less than 10 mm.

2. The pump as claimed in claim 1, in which the impeller is a generally disc-shaped impeller mounted in the casing to be driven rotationally about the rotational axis and having a pair of opposed, generally flat walls and a radial profile with a periphery that is generally flat and parallel to an axis of rotation of the impeller.

3. The pump as claimed in claim 2, in which an outlet of the impeller is configured so that a flow of fluid out of the impeller is restricted to generate a buildup of fluid pressure within the impeller.

4. The pump as claimed in claim 3, in which the outlet of the impeller is defined by a circumferential slot that opens axially.

5. The pump as claimed in claim 3, in which the outlet of the impeller is defined by a circumferential slot that opens radially.

6. The pump as claimed in claim 2, which includes a cover arrangement in which the impeller is arranged, the cover arrangement defining a flow restriction aperture so that flow from the impeller into the pump chamber is restricted to generate a buildup of fluid pressure within the impeller.

7. The pump as claimed in claim 2, in which the vortex shaping mechanism is defined by an insert that is configured for location on an internal surface of the sidewall.

8. The pump as claimed in claim 7, in which the insert and the internal surface of the sidewall are configured so that the insert can be positioned on the internal surface in general axial alignment with the impeller.

9. The pump as claimed in claim 7, in which the insert has an outer side that is shaped to correspond with the internal surface of the sidewall and an inner side that is spaced from the outer side at a leading surface and tapers to the outer side at a trailing end.

10. The pump as claimed in claim 9, in which the insert has a leading portion of a constant radius, measured from the rotational axis, along an arc length, and a trailing portion with an increasing radius from the leading portion to the trailing end.

11. The pump as claimed in claim 9, in which the leading surface has a curved radial profile to provide flow transition while inhibiting cavitation.

12. The pump as claimed in claim 9, in which the outer and inner sides and the leading surface are interposed axially between generally flat, radial sides.

* * * * *